US005617192A

United States Patent [19]

Tonomoto et al.

[11] Patent Number: 5,617,192

[45] Date of Patent: Apr. 1, 1997

[54] MULTICOLOR ELECTROSTATIC RECORDING APPARATUS AND ELECTROSTATIC LATENT IMAGE RECORDING APPARATUS USED THEREFOR

[75] Inventors: Yoshihiro Tonomoto; Kenji Fuke; Katsumi Sugimoto; Eiji Suzuki; Keiko Tonai; Shozo Tonai, all of Kawasaki; Hitoshi Yoshii; Tsutomu Kawai, both of Kato-gun; Kunihiko Sato; Katsuya Shimatsu, both of Kawasaki, all of Japan

[73] Assignee: Fujitsu Limited, Kawasaki, Japan

[21] Appl. No.: 537,857

[22] PCT Filed: Mar. 17, 1995

[86] PCT No.: PCT/JP95/00494

§ 371 Date: Nov. 16, 1995

§ 102(e) Date: Nov. 16, 1995

[87] PCT Pub. No.: WO95/25988

PCT Pub. Date: Sep. 28, 1995

[30] Foreign Application Priority Data

Mar. 18, 1994 [JP] Japan ..... 6-049549

[51] Int. Cl.[6] ..... G03G 15/08

[52] U.S. Cl. ..... 399/263

[58] Field of Search ..... 355/260, 245

[56] References Cited

U.S. PATENT DOCUMENTS

| | | | |
|---|---|---|---|
| 4,113,371 | 9/1978 | Fraser et al. | 355/4 |
| 4,982,242 | 1/1991 | Ishii et al. | 355/326 |
| 5,223,898 | 6/1993 | Fujii et al. | 355/259 |
| 5,384,628 | 1/1995 | Takami et al. | 355/259 |

FOREIGN PATENT DOCUMENTS

| | | |
|---|---|---|
| 58-34468 | 2/1983 | Japan . |
| 58-93944 | 6/1983 | Japan . |
| 61-167655 | 10/1986 | Japan . |
| 1-282583 | 11/1989 | Japan . |
| 4-168457 | 6/1992 | Japan . |
| 4-174474 | 6/1992 | Japan . |

*Primary Examiner*—Joan H. Pendegrass
*Assistant Examiner*—Quana Grainger
*Attorney, Agent, or Firm*—Armstrong, Westerman, Hattori, McLeland & Naughton

[57] ABSTRACT

A plurality of electrostatic recording units (Y, C, M and B) are arranged in series along a recording medium moving path. Each electrostatic recording unit includes an electrostatic latent image carrier (48), a developing unit (54, 54') arranged on the upstream side of the electrostatic latent image carrier, and a cleaning unit (60) arranged on the downstream side. The developing unit includes a developer holding container (66) having a developer storage portion (70) and a developer agitating portion (76) located above the developer storage portion. The developer agitating portion is communicated with the developer storage portion via a communicating path (82). The cleaning unit (60) of one of the adjacent electrostatic recording units is disposed adjacent to the developer storage portion (70) of the developer holding container (66) composing a portion of the developing unit (54, 54') of the other electrostatic recording unit.

22 Claims, 15 Drawing Sheets

MULTICOLOR ELECTROSTATIC RECORDING APPARATUS AND ELECTROSTATIC LATENT IMAGE RECORDING APPARATUS USED THEREFOR

TECHNICAL FIELD

The present invention relates to a multicolor electrostatic recording apparatus for recording a multicolor image with a plurality of electrostatic recording units arranged in series. Further the present invention relates to an electrostatic latent image developing apparatus used for the multicolor electrostatic recording apparatus.

BACKGROUND ART

In general, in an electrostatic recording apparatus, an electrostatic latent image is written on an electrostatic latent image carrier such as a photoreceptor or a dielectric body; the electrostatic latent image is electrostatically developed with developer so that an electrically charged toner image is formed; the electrically charged toner image is electrostatically transferred onto a recording medium such as a sheet of recording paper; and the toner image is fixed onto the recording medium by heat, pressure or light.

A single drum type multicolor recording apparatus is well known as a multicolor recording apparatus in which the above electrostatic recording technique is used. In this single drum type multicolor recording apparatus, a single electrostatic latent image carrier, for example, a photoreceptor drum is used, and a plurality of developing units are arranged between an electrostatic latent image writing position at which the image is written on the photoreceptor drum and a transfer unit. In this case, developer having a toner component for one color is used for each developing unit. For example, in the case of full color recording, there are provided 4 developing units. In these developing units, developers having toner components of yellow, cyan, magenta and black are respectively used. On the photoreceptor drum, for example, an electrostatic latent image is recorded according to image data of yellow, and the thus recorded electrostatic latent image is developed by yellow toner. Then the yellow toner image is transferred onto a recording sheet and fixed. Next, on the photoreceptor drum, for example, an electrostatic latent image is recorded according to image data of cyan, and the thus recorded electrostatic latent image is developed by cyan toner. Then the cyan toner image is transferred onto a recording sheet on which the yellow toner image has been formed, and then the transferred cyan toner image is fixed. The same image forming process is conducted on the image data of magenta and black. In this way, toner images of 4 colors are superimposed on the recording sheet, and image recording of full color is accomplished. The above single drum type multicolor recording apparatus is advantageous in that the overall arrangement can be made relatively compact, however, it is necessary to form a toner image of each color with the single photoreceptor drum. Accordingly, it is impossible to form a multicolor image at high speed.

As another type multicolor recording apparatus in which the electrostatic recording technique is used, there is provided a multi-drum type multicolor recording apparatus. In the case of full color recording conducted by this multi-drum type multicolor recording apparatus, 4 sets of electrostatic recording units are used, in which each unit is assembled into the aforementioned electrostatic recording apparatus. These electrostatic recording units are arranged in series along a recording sheet conveyance path. When a recording sheet passes through the electrostatic recording units, toner images of respective colors are transferred and superimposed on the recording sheet. Due to the foregoing, a full color image is formed on the recording sheet.

As described above, the multi-drum type multicolor electrostatic recording apparatus is advantageous in that multicolor recording can be accomplished at high speed. However, since a plurality of electrostatic recording units are arranged in series in the multi-drum type multicolor electrostatic recording apparatus, the dimensions of the structure are increased, which causes a problem in the practical use of the recording apparatus.

In order to accomplish recording a multicolor image of high quality by the multi-drum type multicolor electrostatic recording apparatus, it is necessary that an electrostatic latent image is stably developed at high speed by the electrostatic latent image developing apparatus used in each electrostatic recording unit.

DISCLOSURE OF INVENTION

It is an object of the present invention to provide a multicolor electrostatic recording apparatus in which a plurality of electrostatic recording units are arranged in series so as to conduct multicolor recording, and the overall arrangement can be made compact.

It is another object of the present invention to provide an electrostatic latent image developing apparatus used for the multicolor electrostatic recording apparatus, by which an electrostatic latent image can be stably developed at high speed.

A multicolor electrostatic recording apparatus of the present invention is comprised of a plurality of electrostatic recording units arranged in series along a recording medium conveyance path. Each electrostatic recording unit comprises: an electrostatic latent image carrier arranged in the recording medium conveyance path; a developing means arranged in the recording medium conveyance path on an upstream side of the electrostatic latent image carrier; and a cleaning means arranged in the recording medium conveyance path on a downstream side of the electrostatic latent image carrier. The developing means comprises a developer holding container having a developer storage section and a developer agitating section disposed at an upper position of the developer storage section, wherein a portion of the developer held in the developer agitating section is successively supplied to the developer storage section. The developing means further comprises a developer carrier arranged in the developer storage section, wherein the developer carrier is partially exposed so that a portion of the developer carrier can be opposed to the electrostatic latent image carrier. This developer carrier conveys developer from the developer storage section to a region where the developer carrier is opposed to the electrostatic latent image carrier so as to develop an electrostatic latent image formed on the electrostatic latent image carrier. The developing means further comprises a developer lifting means for lifting the developer, conveyed to the opposing region by the developer carrier, to the developer agitating section in the developer holding container. The above multicolor electrostatic recording apparatus according to the present invention is characterized in that a cleaning means of one of the two electrostatic recording units, which are adjacent to each other, is arranged adjacent to a developer storage section of the developer holding container which composes a portion of the developing means of the other electrostatic recording unit.

As can be seen from the above arrangement, in the multicolor electrostatic recording apparatus according to the present invention, the developer agitating section of the developer holding container, which composes a portion of the developing means, is disposed at a position higher than the developer storage section. Accordingly, the size of the developer storage section can be greatly reduced. Due to the foregoing, when the cleaning means of one of the two electrostatic recording units, which are adjacent to each other, is arranged being adjacent to the developer storage section of the developer holding container which composes a portion of the developing means of the other electrostatic recording unit, it is possible to reduce an interval of the electrostatic recording units in accordance with the reduction of the size of the developer storage section.

BRIEF DESCRIPTION OF THE DRAWINGS

These and other objects and advantages of the invention will be apparent to those skilled in the art upon reference to the following detailed description of preferred embodiments thereof, which description makes reference to the accompanying drawings.

FIG. 10 is a transversely cross-sectional view that is the same as FIG. 8, wherein FIG. 10 is a view showing a variation of the developing unit shown in FIG. 8.

BEST MODE FOR CARRYING OUT THE INVENTION

Figure 1:
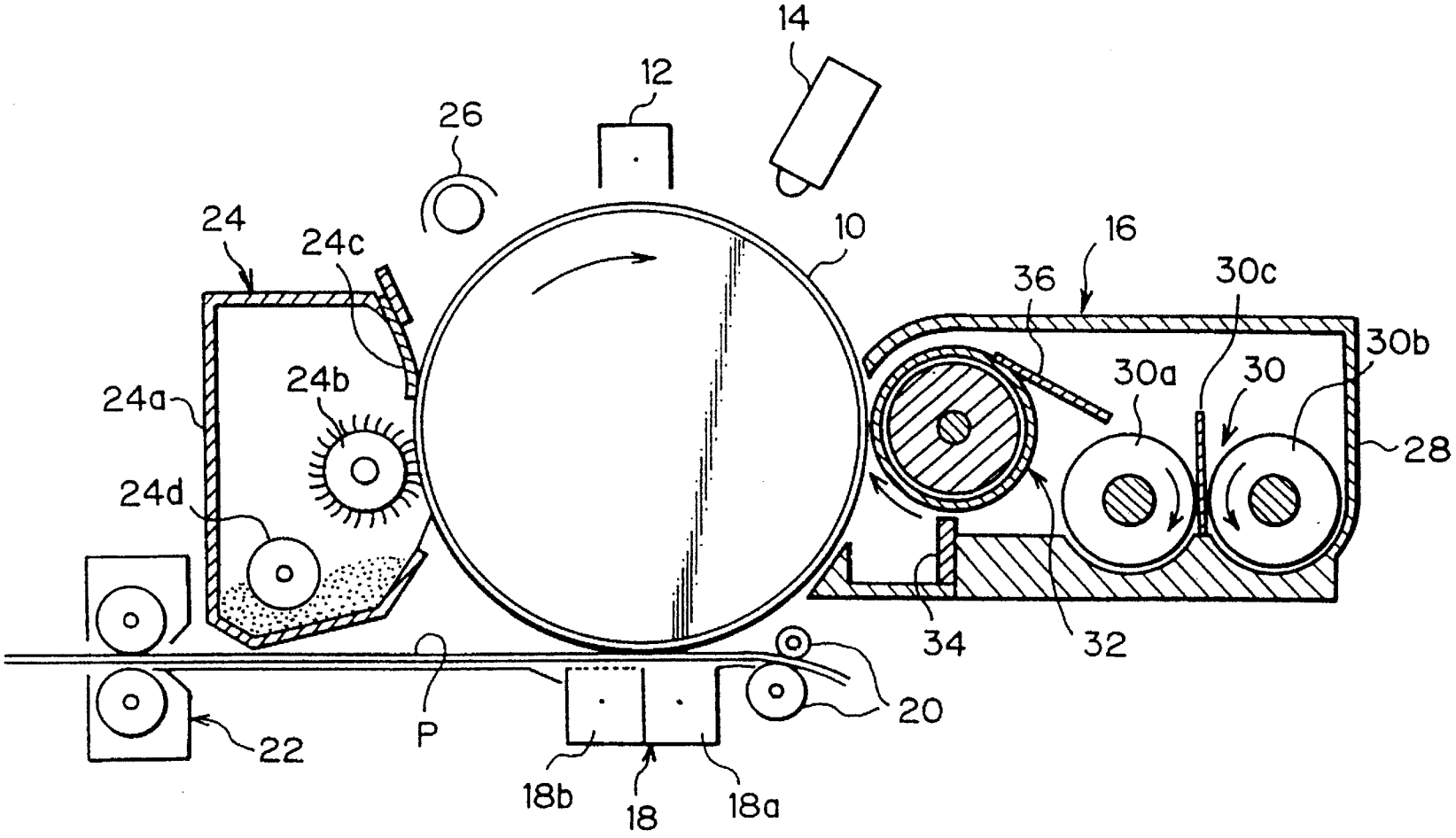
Fig.1 PRIOR ART
FIG. 1 is a schematic illustration showing an example of the conventional electrostatic recording apparatus.

In FIG. 1, there is shown a high speed printer, which is an example of the conventional electrostatic recording apparatus, to which the electrophotographic system is applied. In this high speed printer, a photoreceptor drum 10 is used as the electrostatic latent image carrier. In the process of recording, the photoreceptor drum 10 is rotated in the direction of an arrow shown in the drawing. The photoreceptor drum 10 is uniformly charged by a pre-charger 12, and an electrostatic latent image is written in the charged region by an optical writing means 14. In this connection, the pre-charger 12 may be a corona charging unit, for example, a scorotron charging unit or a corotron charging unit. Except for the above charging units, it is possible to use a charging unit such as a conductive roller charging unit or a conductive brush charging unit. Examples of the optical writing means are: a laser beam scanner, an LED (light emitting diode) array, and a liquid crystal shutter array. An electrostatic latent image written on the photoreceptor drum 10 is electrostatically developed to be a charged toner image by the developing unit 16. The charged toner image is electrostatically transferred onto a recording medium P such as a sheet of recording paper by a transfer unit 18. In this case, the transfer operation is carried out as follows. The recording medium, that is, the recording sheet P is supplied from a sheet supply section not shown in the drawing; the recording sheet P is temporarily stopped at the position of a pair of register rollers 20 and waits for the next operation; the recording sheet P is sent to a position between the photoreceptor drum 10 and the transfer unit 18 by the pair of register rollers 20 in a timed relation to the writing operation of the electrostatic latent image on the photoreceptor drum 10; and the charged toner image is transferred onto the recording sheet P at a predetermined position. In this connection, in the example shown in the drawing, the transfer unit 18 includes a transfer section **18*a* composed of a corona discharger, and a discharging section 18*b* composed of an AC discharger. The transfer section 18*a* gives an electric charge, the polarity of which is reverse to the polarity of the charged toner image, to the recording sheet P, so that the charged toner image can be transferred from the photoreceptor drum 10 onto the recording sheet P. The discharging unit 18*b* partially removes an electric charge from the recording sheet P immediately after the transfer of the charged toner image, so that the recording sheet P can be easily separated from the photoreceptor drum 10. After the completion of the transfer process, the recording sheet P is sent to the fixing unit 22**, and the transferred toner image is fixed onto the recording sheet P.

On the other hand, after the transfer process has been completed, residual toner, which has not been transferred onto the recording sheet P, is deposited on a surface of the photoreceptor drum 10. This residual toner is removed from the surface of the photoreceptor drum 10 by the cleaning unit 24. Of course, in a high speed printer, it is necessary to quickly and positively remove the residual toner from the surface of the photoreceptor drum 10. Since the high speed printer conducts recording on a large number of recording sheets, the quantity of residual toner to be processed is increased. Therefore, the cleaning unit 24 illustrated in FIG. 1 is commonly used in the high speed printer. The arrangement of the cleaning unit 24 will be described in detail as follows. The cleaning unit 24 includes: a toner recovery container 24*a* having an opening portion through which a portion of the photoreceptor drum 10 is received; a fur brush 24*b* arranged in the toner recovery container 24*a* in such a manner that the fur brush 24*b* is disposed close to the opening portion of the toner recovery container 24*a*; a toner scraping blade 24*c* arranged along an upper edge of the opening portion of the toner recovery container 24*a*; and a conveyance screw 24*d* arranged in a bottom portion of the toner recovery container 24*a*. In this case, the fur brush 26*b* brushes away the residual toner from the surface of the photoreceptor drum 10, and the scraping blade 24*c* scrapes off the residual toner that cannot be removed by the fur brush 24*b*. Residual toner removed by the fur brush 24*b* and the scraping blade 24*c* is temporarily recovered into the toner recovery container 24*a*. The recovered toner is conveyed from the toner recovery container 24*a* to a predetermined place by the toner conveyance screw 24*d*. Due to the structure described above, the size of the cleaning unit 24 is relatively large. After the residual toner has been removed from the surface of the photoreceptor drum 10 by the cleaning unit 24, the cleaned surface is irradiated by rays of light emitted from the discharge lamp 26, so that the residual electric charge can be removed.

Figure 2:
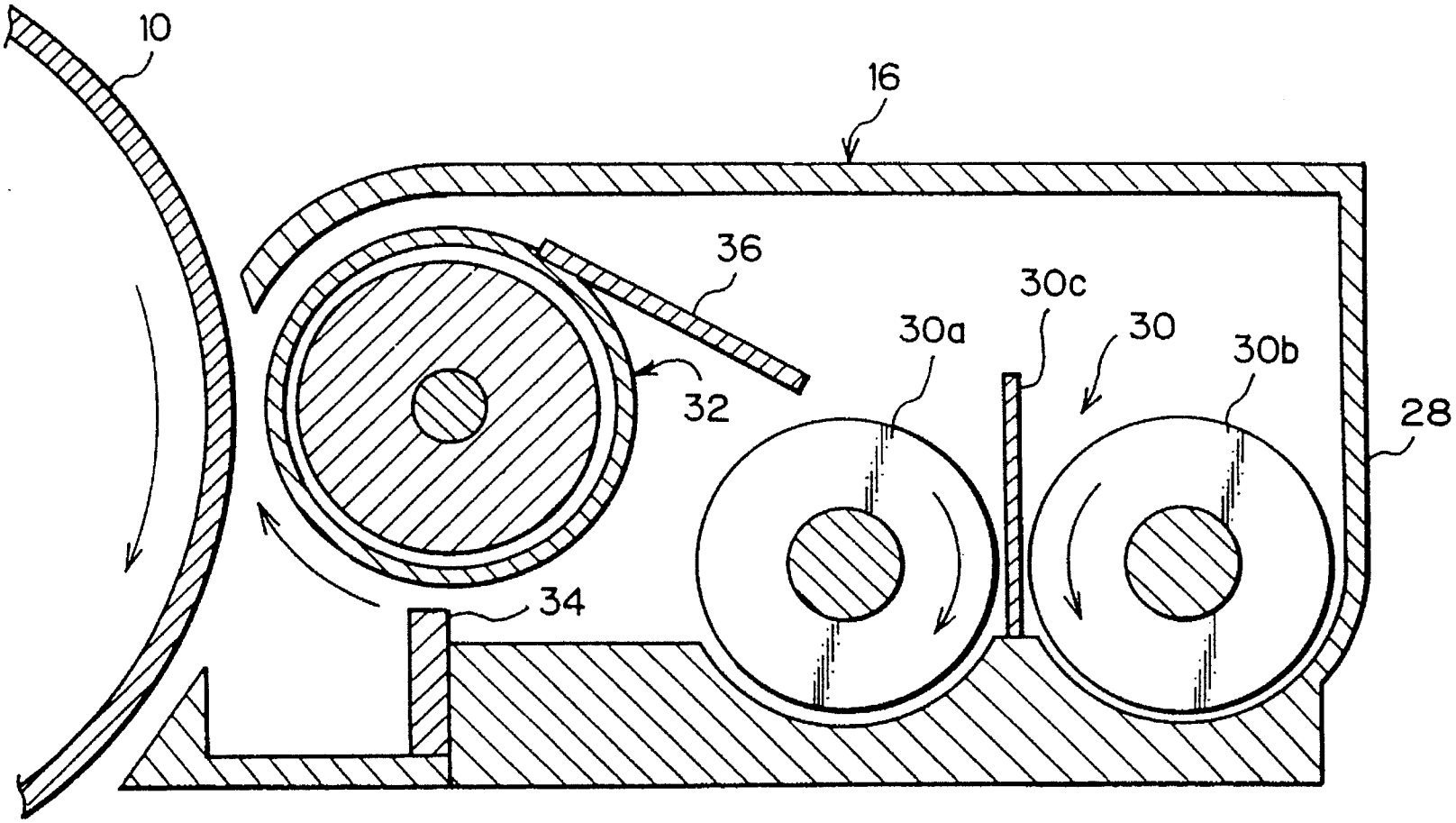
Fig. 2 PRIOR ART
FIG. 2 is an enlarged cross-sectional view showing an outline of the developing unit of the electrostatic recording apparatus shown in FIG. 1.

Concerning the developer used in the above developing process, a two-component developer composed of a toner component (fine particles of colored resin) and a magnetic component (fine particles of magnetic carrier) is well known. Especially in the case of multicolor recording, it is common to use a two-component developer. As illustrated in FIG. 2, a developing unit using a two-component developer includes: a developer container 28 for holding two-component developer; an agitator 30 for triboelectrically charging the two-component developer by agitating the toner component and the magnetic carrier component; and a magnetic roller, that is, a developing roller 32 for forming a magnetic brush when a portion of the magnetic carrier is attracted by the magnetic force. A portion of the developing roller 32 is exposed from the developer holding container so that the portion is opposed to the photoreceptor drum 10. The toner component is electrostatically deposited on the magnetic brush formed around the developing roller 32. When the developing roller is rotated, the toner component is conveyed to an opposing region, at which the developing roller is opposed to the photoreceptor drum 10, that is, the toner component is conveyed to a developing region being accompanied by the magnetic brush, and the electrostatic latent image is developed here. The development density of an electrostatic latent image is also determined by the quantity of toner conveyed to the developing region. Therefore, in order to maintain the development density to be uniform, the length of the magnetic brush is regulated by a regulating blade 34. Developer that has passed through the developing region, that is, developer, the quantity of toner component of which has been decreased, is scraped off from the developing roller 32 by the scraper member 36 and returned to the agitator 30 side.

When the two-component developer is used for development, the toner component is continually consumed in the developing process. Therefore, in order to maintain the quality of a developed toner image, it is necessary to replenish an appropriate quantity of toner component. The quality of the recorded toner image is determined not only by the triboelectric charging conducted between the toner component and the magnetic carrier, but it is also determined by the uniformity of the distribution of the toner component in the magnetic carrier. In the case of a high speed printer, the quantity of developer consumed in the developing process is naturally increased. Therefore, it is necessary to agitate the developer quickly and effectively. For this reason, a circulation type agitator 30 shown in the drawing is commonly used. Specifically, the agitator 30 includes a pair of conveyance screws 30*a*, 30*b*, and a partition plate 30*c* arranged between the pair of conveyance screws 30*a*, 30*b*. The pair of conveyance screws 30*a*, 30*b* are arranged in the developer holding container 28 in parallel to the developing roller 32. The pair of conveyance screws 30*a*, 30*b* are arranged between both walls of the developer holding container 28. Length of the partition wall 30*c* is longer than that of the conveyance screw, so that both end portions of the partition wall 30*c* are separate from the side walls of the developer holding container 28 by a predetermined distance. The conveyance screws 30*a*, 30*b* are driven in such a manner that the developer can be conveyed in the opposite direction to each other. Due to the above structure, a developer circulation path can be formed. That is, the developer is circulated as follows. When the developer is conveyed by the conveyance screw 30*a* to its end, the developer passes through an end portion of the partition plate 30*c* and is moved to the conveyance screw 30*b* side. When the developer is conveyed by the conveyance screw 30*b* to its end, the developer passes through an opposite end portion of the partition plate 30*c*. Therefore, the developer is moved again to the conveyance screw 30*a* side. In this way, the developer is circulated along the conveyance screws 30*a* and 30*b*. A large quantity of developer can be effectively agitated by the developing unit having the agitator 30 described above, however, the size of the overall arrangement is increased.

Figure 3:
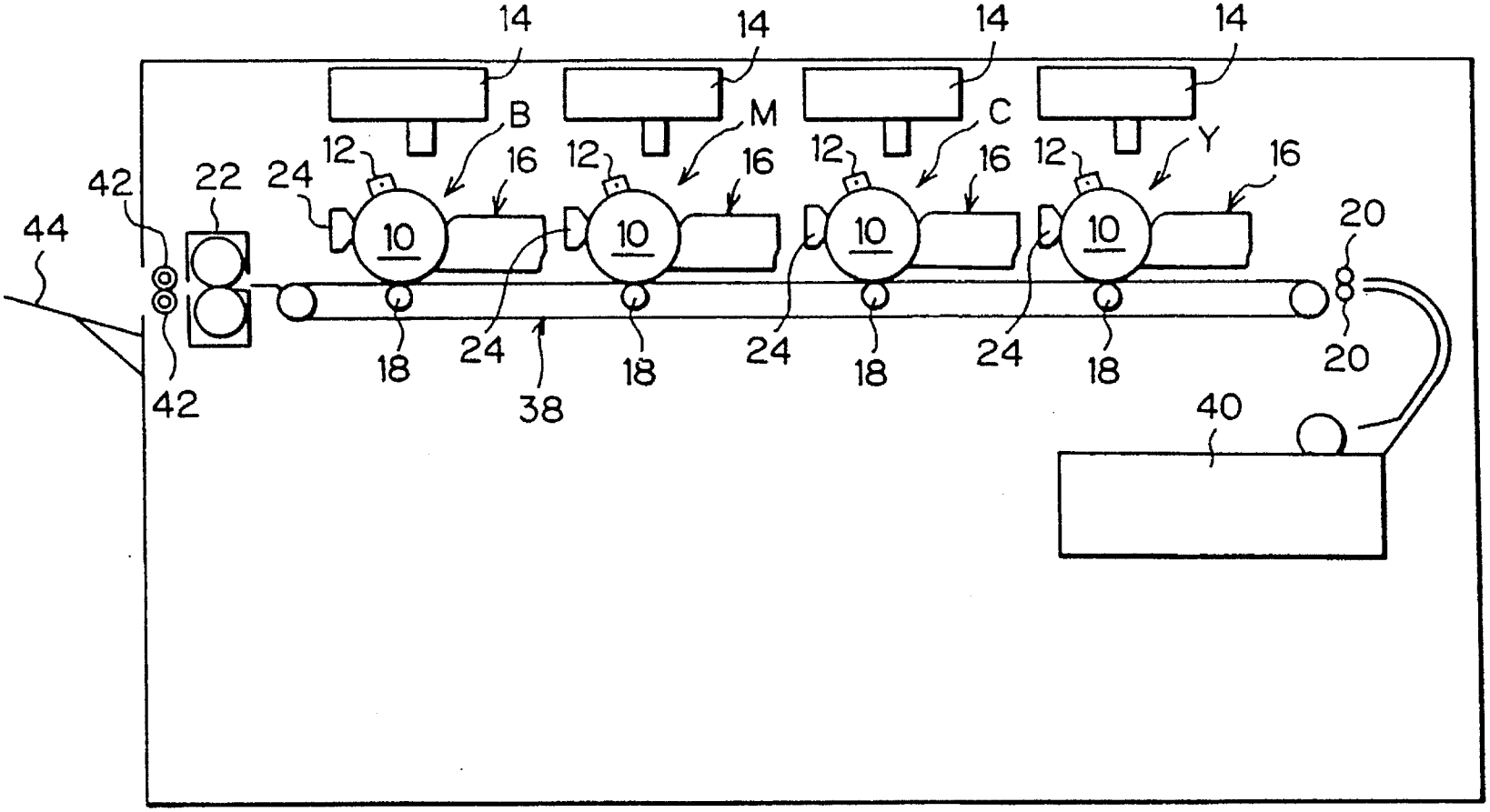
Fig. 3 PRIOR ART
FIG. 3 is a schematic illustration showing a conventional multicolor electrostatic recording apparatus composed of a plurality of electrostatic recording units in which the electrostatic recording apparatus shown in FIG. 1 is integrated into a unit.

FIG. 3 is a view showing an example of the multi-drum type multicolor electrostatic recording apparatus by which full color recording is conducted. In this multicolor electrostatic recording apparatus, 4 sets of electrostatic recording units Y, C, M and B are used. The electrostatic recording units Y, C, M and B are aligned in series on an endless belt means 38 for conveying recording sheets. In this case, the electrostatic recording units Y, C, M and B have the same structure. Each electrostatic recording unit is provided when the electrostatic recording apparatus illustrated in FIG. 1 is integrated into one unit. Accordingly, like parts are identified by the same reference character in each of FIGS. 1 and 3. Each electrostatic recording unit Y, C, M, B is characterized in that: the optical writing means 14 is composed of a laser beam scanner; and the transfer unit 18 is composed of a conductive transfer roller. In this case, the conductive transfer roller 18 comes into pressure contact with the photoreceptor drum 10 via an upper traveling section of the endless belt means 38 for conveying recording sheets. For the developing units 16 of Y, C, M and B, the developer having a yellow toner component, the developer having a cyan toner component, the developer having a magenta toner component, and the developer having a black toner component are respectively used. That is, in the respective electrostatic recording units Y, C, M and B, a yellow toner image, a cyan toner image, a magenta toner image and a black toner image are recorded. At one end of the endless belt means 38 for conveying recording sheets, that is, on the introduction side for introducing recording sheets, a pair of register rollers 20 are arranged. In the recording operation, a recording sheet sent from the sheet supply section 40 is temporarily stopped at a position of the pair of register rollers 20 and waits for the next operation. In the electrostatic recording units Y, C, M and B, an electrostatic latent image is written on the photoreceptor drum 10 according to the image data of each color. Next, in timed relation to the formation of the electrostatic latent image, the recording sheet is made to pass through the printer Y, C, M and B sequentially. Due to the foregoing, images of yellow, cyan, magenta and black are successively transferred onto the recording sheet, so that a full color image can be formed. After the full color image has been formed on the recording sheet, it passes through the fixing unit 22 arranged at the other end of the endless belt means 38 for conveying recording sheets. The full color image is fixed onto the recording sheet by the fixing unit 22. Then the recording sheet is ejected by the ejection roller 42 onto a sheet ejection tray 44 arranged outside the multicolor recording apparatus.

As described above, this multi-drum type multicolor electrostatic recording apparatus is advantageous in that the formation of a multicolor image can be accomplished at high speed. However, in the above multi-drum type multicolor electrostatic recording apparatus, a plurality of electrostatic recording units are arranged in series. Therefore, the size of the apparatus is increased. Especially, in the case of a high speed printer shown in FIG. 1, the apparatus is composed in such a manner that the developing and cleaning units are relatively bulky. Accordingly, the size of the multicolor electrostatic recording apparatus is further increased.

Next, with reference to FIGS. 4 to 16, various embodiments of the multicolor electrostatic recording apparatus of the present invention will be explained below.

Figure 4:
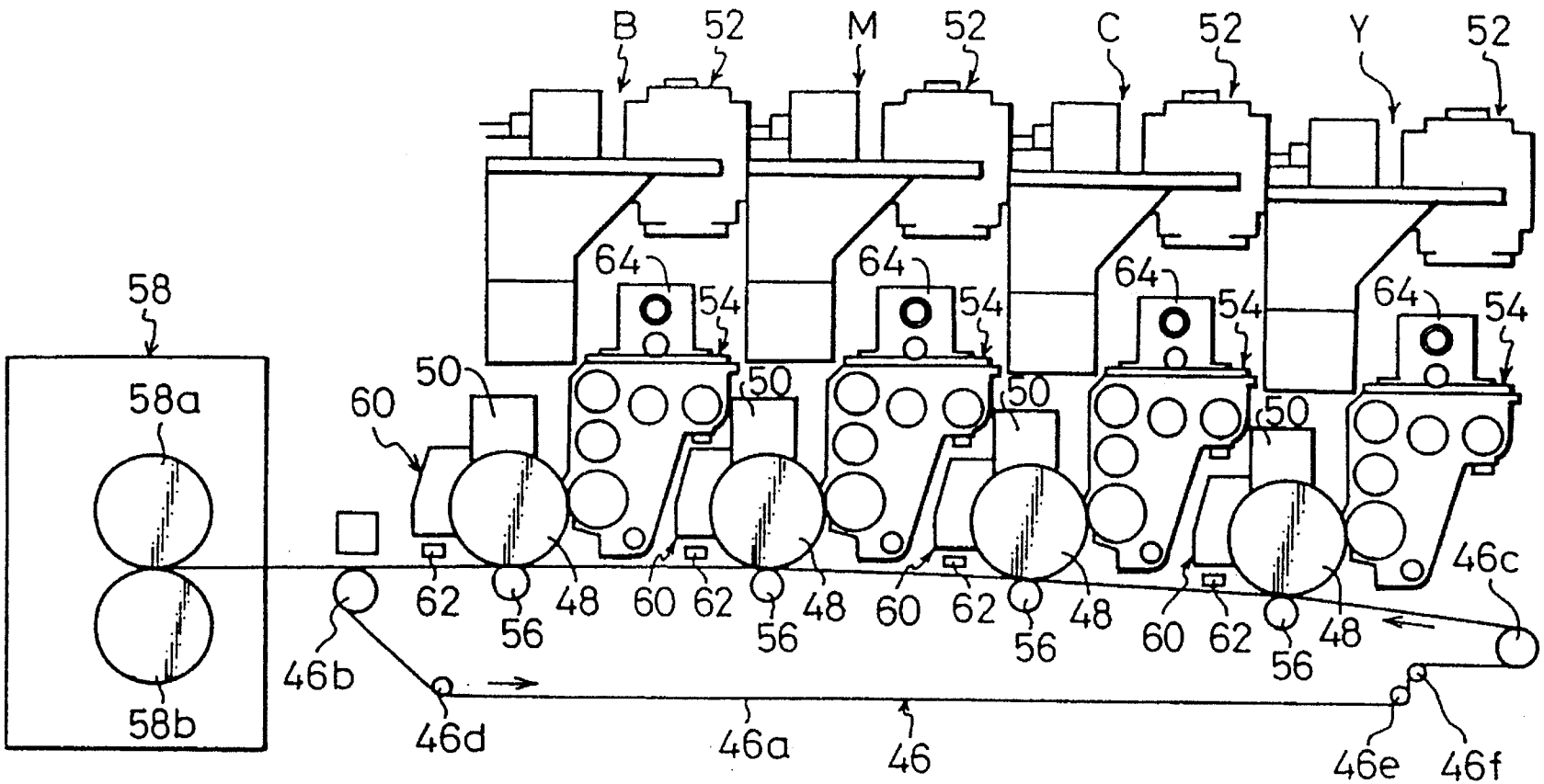
FIG. 4 is an elevation view showing an outline of an example of the multicolor electrostatic recording apparatus of the present invention.

An embodiment of the multicolor electrostatic recording apparatus of the present invention is shown in FIG. 4. This multicolor electrostatic recording apparatus includes an endless belt conveyance means 46 for conveying a recording medium, for example, a recording sheet. The endless belt conveyance means 46 is composed of an endless belt **46*a* made of flexible dielectric material, for example, an appropriate synthetic resin. This endless belt 46*a* is provided around 4 rollers 46*b*, 46*c*, 46*d*, 46*e*. The roller 46*b* is a drive roller. This drive roller 46*b* drives the endless belt 46*a* in the arrowed direction by an appropriate drive mechanism not shown in the drawing. The roller 46*c* functions as an idle roller. This roller 46*c* also functions as a charging roller to give an electric charge onto the endless belt 46*c*. Both rollers 46*d* and 46*e* function as guide rollers. The guide roller 46*d* is disposed close to the drive roller 46*b*, and the guide roller 46*e* is disposed close to the idle roller 46*c*. There is provided a tension roller 46*f* between the idle roller 46*c* and the guide roller 46*e*. The endless belt 46*a* is given an appropriate intensity of tension by this tension roller 46*f*. There is formed a recording sheet movement path in an upside sheet traveling section of the endless belt 46*a*, that is, a sheet traveling section formed between the drive roller 46*b* and the idle roller 46*c*. A recording sheet is introduced into the sheet traveling section from the side of the idle roller 46*a* and ejected from the side of the drive roller 46*b*. When the recording sheet is introduced to the sheet traveling section from the side of the idle roller 46*a*, the recording sheet is attracted onto the endless belt 46*a* by the action of the electric charge on the endless belt 46*a*. There is provided an AC discharging unit 46*g* on the side of the drive roller 46*b*. The endless belt 46*a* is electrically discharged by the AC discharging unit 46*g*. Due to the foregoing, when the recording sheet is ejected from the side of the drive roller 46*b*, it can be easily separated from the endless belt 46*a***.

The multicolor electrostatic recording apparatus comprises 4 sets of electrostatic recording units Y, C, M and B. These electrostatic recording units Y, C, M and B are arranged in series along the upside sheet traveling section of the endless belt **46*a* from the upstream side to the downstream side. The electrostatic recording units Y, C, M and B have the same structure, however, colors of the images formed by the electrostatic recording units Y, C, M and B are different. Each electrostatic recording unit is provided with a photoreceptor drum 48. In the process of the recording operation, the photoreceptor drum 48 is rotated in the arrowed direction in the drawing. Above the photoreceptor drum 48, there is provided a pre-charger 50 which is composed of a corona charging unit such as a scorotron charging unit or a corotron charging unit. A rotational surface of the photoreceptor drum 48 is uniformly charged by the pre-charger 50. An electrostatic latent image is written in the electrically charged region on the photoreceptor drum 50 by an optical writing means such as a laser beam scanner 52. In this connection, the laser beam scanner 52 is the bulkiest among the components composing the electrostatic recording unit. Therefore, the laser beam scanner 52** is arranged at the uppermost position so that the installation space of the electrostatic recording unit can be reduced.

The electrostatic latent image written on the photoreceptor drum 48 is electrostatically developed by the developing unit 54 using toner of a predetermined color, so that an electrically charged toner image can be formed. The developing unit 54 is arranged on the upstream side of the recording movement path with respect to the photoreceptor drum 48. The electrically charged toner image is electrostatically transferred onto a recording medium such as a recording sheet by the conductive transfer roller 56 disposed at a lower position of the photoreceptor drum 40. As shown in FIG. 4, the conductive transfer roller 56 is opposed to the photoreceptor drum 48 via an upside sheet traveling section on the endless belt **46*a*. The conductive transfer roller 56 gives an electric charge, the polarity of which is reverse to the polarity of the electrically charged toner image, to the recording sheet conveyed by the endless belt 46*a*. Due to the foregoing, the electrically charged toner image is electrostatically transferred from the photoreceptor drum 56** onto the recording sheet.

According to the above structure, the operation is carried out as follows. When the recording sheet is introduced by the idle roller **46*c* of the endless belt conveyance means 46 and successively passes through the electrostatic recording units Y, C, M and B, toner images of 4 colors are superimposed on the recording sheet so that a full color image can be formed. Then, the recording sheet is sent from the drive roller 46*b* of the endless belt conveyance means 46 to the thermal fixing unit 58. Then the full color image is thermally fixed onto the recording sheet by the thermal fixing unit 58. In this connection, the thermal fixing unit 58 is of the conventional type composed of a heat roller 58*a* and a backup roller 58*b*. On the other hand, in each electrostatic recording apparatus, residual toner, which is left on the surface of the photoreceptor drum 48 without being transferred onto the recording sheet, is deposited on the surface of the photoreceptor drum 48 after the completion of the transfer process. This residual toner is removed from the surface of the photoreceptor drum 48 by the cleaning unit 60. This cleaning unit 60 is arranged on the downstream side of the recording sheet movement path with respect to the photoreceptor drum 48. In this connection, in FIG. 4, reference numeral 62 represents a light emitting body for discharging, such as a light emitting diode, by which the electric charge is removed from the surface of the photoreceptor drum 48 that has completed the transfer process, and reference numeral 64 represents a toner replenishing container for replenishing an appropriate quantity of toner component to the developer 54**.

Figure 5:
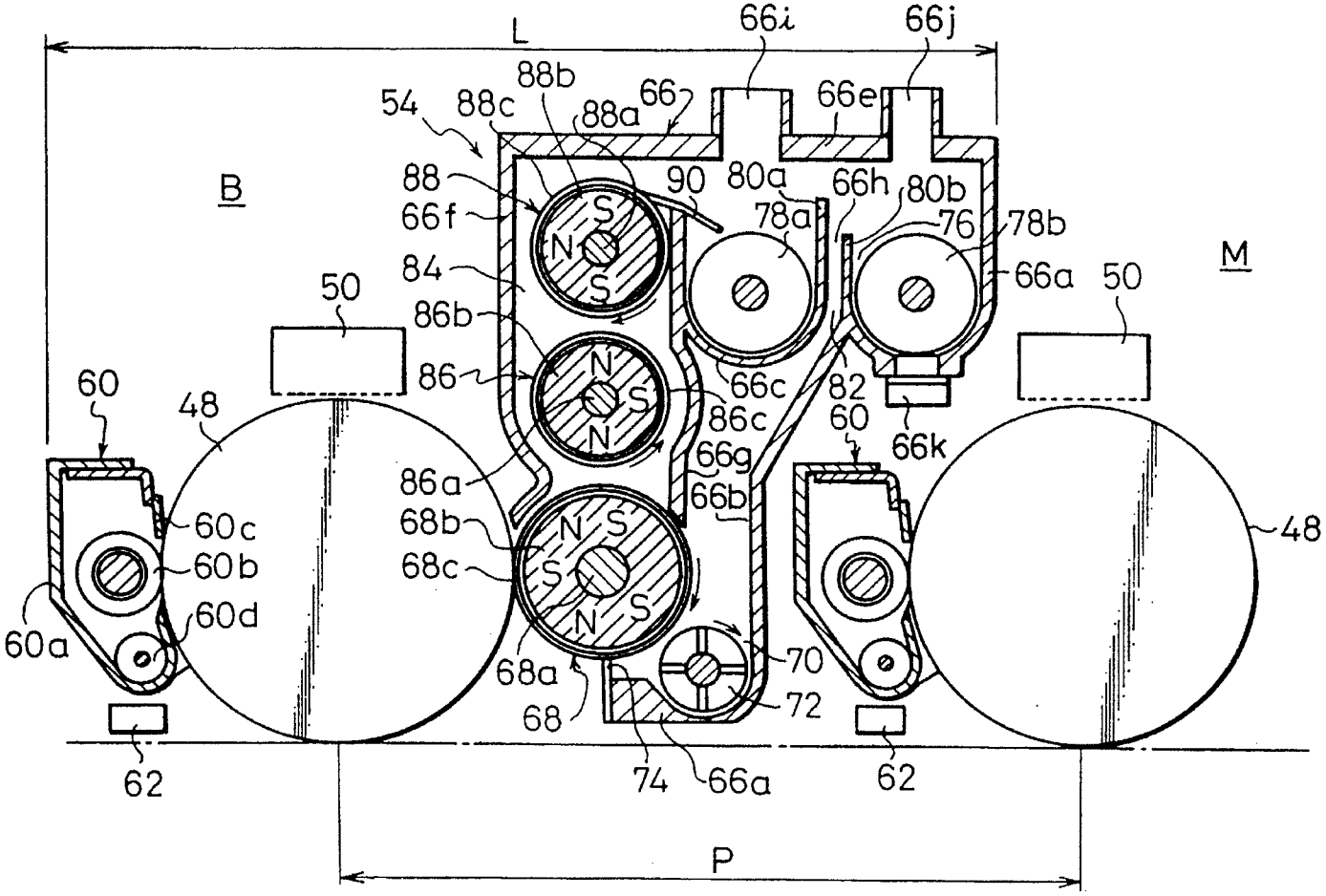
FIG. 5 is a schematic illustration partially showing an arrangement of the electrostatic recording unit of the multicolor electrostatic recording apparatus shown in FIG. 4.

In FIG. 5, there is schematically shown a portion of the electrostatic recording unit B arranged above the endless conveyance belt 46. As shown in FIG. 5, the developing unit 54 includes a developer holding container 66 in which two-component developer is accommodated. The developer holding container 66 includes: a first bottom wall portion 66*a*; a first rear wall portion 66b extending upward from the back of the first bottom wall portion 66*a*; a second bottom wall portion 66*c* extending horizontally at an upper end of the first rear wall portion 66*b*; a second rear wall portion 66*d* extending upward from the back of the second bottom wall portion 66*c*; a top wall portion 66*e* extending horizontally to the front from an upper end of the second rear wall portion 66*d*; and a front wall portion 66*f* extending downward from the front end of the top wall portion 66*e*. Both ends of these wall portions are respectively integrated, with the side wall portions (not shown), into one body. There is provided an opening between the front end of the first bottom wall portion 66*a* of the developer holding container 66 and the lower end of the front wall portion 66*f*. In the opening, there is provided a magnetic roller, that is, a developing roller 68 in such a manner that a portion of the developing roller 68 is exposed outside. The developing roller 68 includes: a shaft 68*a* supported and fixed by both wall portions of the developer holding container 66; a core portion 68*b* made of magnetic material mounted on the shaft 68*a*; and a sleeve 68*c* made of non-magnetic material such as aluminum rotatably arranged around the core portion 68*b*. In the operation of the developing unit 54, the sleeve 68*c* is rotated in the arrowed direction in the drawing. When the developing unit 54 shown in the drawing is installed in the electrostatic recording apparatus, an exposed surface of the developing roller 68, that is, the sleeve 68*c* is opposed to an electrostatic latent image carrier such as a photoreceptor drum.

By the first bottom wall portion 66*a* of the developer holding container 66, a developer storage portion 70 is formed, in which a paddle roller 72 is provided. This paddle roller 72 is rotatably supported by both side wall portions of the developer holding container 66. In the operation of the developing unit 54, the paddle roller 72 is driven in the arrowed direction shown in the drawing. The paddle roller 72 supplies the developer accommodated in the developer storage portion 70 toward the developing roller 68. In the same manner as that shown in FIG. 3, the developer is carried by the developing roller 68 and conveyed to an opposing region in which the developing roller 68 is opposed to an electrostatic latent image carrier such as a photoreceptor drum, that is, the developer is conveyed to a developing region. In order to regulate a quantity of developer to be conveyed to the developing region by the developing roller 68, a developer regulating blade 74 is mounted on a front edge of the first bottom wall portion 66*a*.

The second bottom wall portion 66*c* of the developer holding container 66 provides a developer agitating portion 76 located above the developer storage portion 70. In this developer agitating portion 76, there is provided a developer agitator 78. As can be seen in FIG. 5, the developer agitating portion 76 partially protrudes to the rear side of the developer storage portion 70, and a space is formed under this protruding portion. In this embodiment, the developer agitator 78 is composed of a pair of conveyance screws 78*a*, 78*b* provided between both end walls of the developer holding container 66. This pair of conveyance screws 78*a*, 78*b* are disposed in parallel to each other. As can be seen in FIG. 5, on an upper face of the second bottom wall portion 66*c*, there are formed a pair of curved recess portions in which the pair of conveyance screws 78*a*, 78*b* are received. Shafts of the conveyance screws 78*a*, 78*b* are rotatably supported by both side walls of the developer holding container 46. In the operation of the developing unit 54, the shafts of the conveyance screws 78*a*, 78*b* are rotated in the arrowed directions respectively shown in the drawing, that is, the shafts of the conveyance screws 78*a*, 78*b* are rotated in the directions opposite to each other. In this embodiment, the blades of both conveyance screws 78*a*, 78*b* are composed in the manner of a right-handed screw. Therefore, the conveyance screw 78*a* conveys developer in a direction perpendicular to the surface of FIG. 5 to a side opposite to the viewer's side. The conveyance screw 78*b* conveys developer in a direction perpendicular to the surface of FIG. 5 to the viewer's side. Between the conveyance screws 78*a* and 78*b*, there are provided a pair of partition walls 80*a* and 80*b* which are perpendicular to the second bottom wall portion 66*c*. Lengths of the pair of partition walls 80*a* and 80*b* are shorter than the lengths of the conveyance screws 78*a* and 78*b*, and both ends of the pair of partition walls 80*a* and 80*b* are separate from the side wall portions by a predetermined distance. Accordingly, in the same manner as that shown in FIG. 3 in which developer is conveyed by the conveyance screws 30*a* and 30*b*, a developer circulation path is formed by the conveyance screws 78*a* and 78*b*. That is, the developer is circulated as follows. When the developer is conveyed by the conveyance screw 78*a* to its end, the developer passes through end portions of the pair of partition plates 80*a*, 80*b* and is moved to the conveyance screw 78*b* side. When the developer is conveyed by the conveyance screw 78*b* to its end, the developer passes through the opposite end portions of the pair of partition plates 80*a*, 80*b*. Therefore, the developer is moved again to the conveyance screw 78*a* side. In this way, the developer is circulated along the pair of conveyance screws 58*a* and 58*b*.

Between the pair of partition plates 80*a*, 80*b*, there is provided a communication path 82 to communicate the developer storage portion 70 with the developer agitating portion 76, and an upper opening of this communication path 82 forms a developer overflow port 66*h* for the developer accommodated in the developer agitating portion 76. As shown in FIG. 5, the partition plate 80*b* is lower than the partition plate 80*a*, so that an upper edge of the partition plate 80*b* works as a developer overflow edge. That is, a portion of the developer circulated by the conveyance screws 78*a*, 78*b* overflows the upper edge of the partition plate 80*b* and drops into the communication path 82. Due to the foregoing, the developer is supplied from the developer agitating portion 76 to the developer storage portion 70.

As shown in FIG. 5, a vertical partition wall portion 66*g* is integrally formed on the front wall portion of the second bottom wall portion 66*c* of the developer holding container 66. There is formed a developer elevating path 84 between the vertical partition wall portion 66*g* and the front wall portion 66*f*. As can be seen in FIG. 5, this developer elevating path 82 is arranged immediately above the developing roller 68. In the developer elevating path 84, there are provided two magnetic rollers 86 and 88 which are aligned in the vertical direction with respect to the developing roller 68. The magnetic rollers 86 and 88 have the same structure as that of the developing roller 68 which is composed as a magnetic roller. Each magnetic roller 86, 88 includes: a shaft 86*a*, 88*a* supported and fixed by both wall portions of the developer holding container 66; a core portion 86*b*, 88*b* made of magnetic material mounted on the shaft; and a sleeve 86*c*, 88*c* made of non-magnetic material such as aluminum rotatably arranged around the core portion 68*b*. In the operation of the developing unit 54, the sleeves 86*c*, 88*c* are rotated in the arrowed directions shown in the drawing. The core portion 68*b* of the developing roller 68, the core portion 86*b* of the magnetic roller 86, and the core portion 88*b* of the magnetic roller 88 are locally magnetized along the peripheries as shown in FIG. 5. When the core portions 68*b*, 86*b*, 88*b* are locally affected by the magnetic field, it is possible to accomplish the local magnetization as described above. Magnetic poles of the core portion 68*b* of the developing roller 68 are arranged so that the developer can be conveyed from the developer storage portion 70 to the developing region in accordance with the rotation of the sleeve 68*c*. In this way, the developer is conveyed to the lower side of the magnetic roller 86. Magnetic poles of the core portion 86*b* of the magnetic roller 86 are arranged so that the developer can be lifted from the upside of the developing roller 68 to the downside of the magnetic roller 88 in accordance with the rotation of the sleeve 86*c*. Magnetic poles of the core portion 88*b* of the magnetic roller 88 are arranged so that the developer can be lifted from the upside of the magnetic roller 86 to the upside of the magnetic roller 88 in accordance with the rotation of the sleeve 88*c*. Due to the foregoing structure, the developer conveyed to the developing region by the developing roller 68 is not returned to the developer storage portion 70 but raised to the upside of the uppermost magnetic roller 88.

A scraper member 90 is mounted on the upper end of the vertical partition wall portion 66*g*. A front end of this scraper member 90 contacts with the magnetic roller 88 at a position located a little to the rear of the top of the magnetic roller 88. After the developer has been raised to the upside of the magnetic roller 88, it is supplied to the conveyance screw 78*a* of the developer agitating portion 76 by the action of the scraper member 90.

To sum up, the developer held in the developer holding container 66 is supplied from the developer agitating portion 76 to the developer storage portion 70 via the developer overflow outlet 66*h* and communication path 82; then the developer is conveyed from the developer storage portion 70 to the developing region by the developing roller 68; after the developer has passed through the developing region, it is successively raised by the magnetic rollers 86, 88; and finally, the developer is returned to the developer agitating portion 76 via the scraper member 90. In this way, when the developing unit 54 is operated, the developer is continuously circulated in the developer holding container 66. Due to the foregoing, it can be ensured that the sufficiently agitated developer is always supplied to the developer storage portion 70, (that is, in the supplied developer, the components of toner and magnetic carrier are triboelectrically charged and the toner component is uniformly distributed in the magnetic carrier component).

The structure of the developing unit 54 described above is characterized in that: the developer holding container 66 is divided into the developer storage portion 70 and the developer agitating portion 66; and the relatively bulky developer agitating portion 66 is arranged at an upper position of the developer storage portion 70. According to the structure of the developer holding container 66 described above, it is possible to greatly reduce the size of the developer storage portion 70. In this connection, as described above, since the laser beam scanner 52 is the most bulky component among the components which composes the electrostatic recording unit, it is arranged at the uppermost position of the electrostatic recording unit. However, in the uppermost portion of the electrostatic recording unit, there is a sufficiently large space to accommodate the developer agitating portion 76 of the developer holding container 66. For this reason, even if the developer agitating portion 76 is arranged in the upper portion of the developer storage portion 70, the size of the electrostatic recording unit itself is not increased.

Structure of the cleaning unit 60 is the same as that shown in FIG. 1. The arrangement of the cleaning unit 60 will be described in detail as follows. The cleaning unit 60 includes: a toner recovery container 60*a* having an opening portion through which a portion of the photoreceptor drum 48 is received; a fur brush 60*b* arranged in the toner recovery container 60*a* in such a manner that the fur brush 60*b* is disposed close to the opening portion of the toner recovery container 60*a*; a toner scraping blade 60*c* arranged along an upper edge of the opening portion of the toner recovery container 60*a*; and a conveyance screw 60*d* arranged in a bottom portion of the toner recovery container 60*a*. In this case, the fur brush 60*b* brushes away the residual toner from the surface of the photoreceptor drum 48, and the scraping blade 60*c* scrapes off the residual toner that cannot be removed by the fur brush 60*b*. Residual toner removed by the fur brush 60*b* and the scraping blade 60*c* is temporarily recovered into the toner recovery container 60*a*. The recovered toner is conveyed from the toner recovery container 60*a* to a predetermined place by the toner conveyance screw 60*d*.

In FIG. 5, there are also shown a photoreceptor drum 48, a pre-charger 50 and a cleaning unit 60 of the electrostatic recording unit M which is adjacent to the electrostatic recording unit B. In this case, attention should be given to the following specific arrangement. The cleaning unit 60 of the electrostatic recording unit M is adjacent to the developer storage portion 70 of the developer holding container 66 of the electrostatic recording unit B. Further the cleaning unit 60 of the electrostatic recording unit M can be disposed below the developer agitating portion 76 of the electrostatic recording unit B. In other words, according to this embodiment, when the developer agitating portion 76 partially protrudes into the rear side of the developer storage portion 70 of the developer holding container 66 of the electrostatic recording unit B, a space is formed below the developer agitating portion 76, so that the cleaning unit 60 of the electrostatic recording unit M can be accommodated in the space. The aforementioned arrangement is not limited to the electrostatic recording units B and M, but the arrangement can be applied to any two sets of electrostatic recording units which are adjacent to each other. In this way, although the length of each electrostatic recording unit Y, C, M, B in the recording sheet movement direction is "L", the arrangement pitch "P" of the photoreceptor drum 48 can be reduced to a value smaller than the length "L" of each electrostatic recording unit (FIG. 5). Due to the foregoing, the arrangement length of the electrostatic recording unit can be greatly reduced as compared with the conventional electrostatic recording unit. Therefore, the overall structure of the multicolor recording apparatus can be downsized.

In the above embodiment, the two magnetic rollers 68, 88 are used for the developer lifting means for lifting the developer from the developing roller 68 so as to return it to the developer agitating section 76. However, it should be understood that a single magnetic roller may be used for the developer lifting means, if necessary, or alternatively not less than 3 magnetic rollers may be used.

Figure 6:
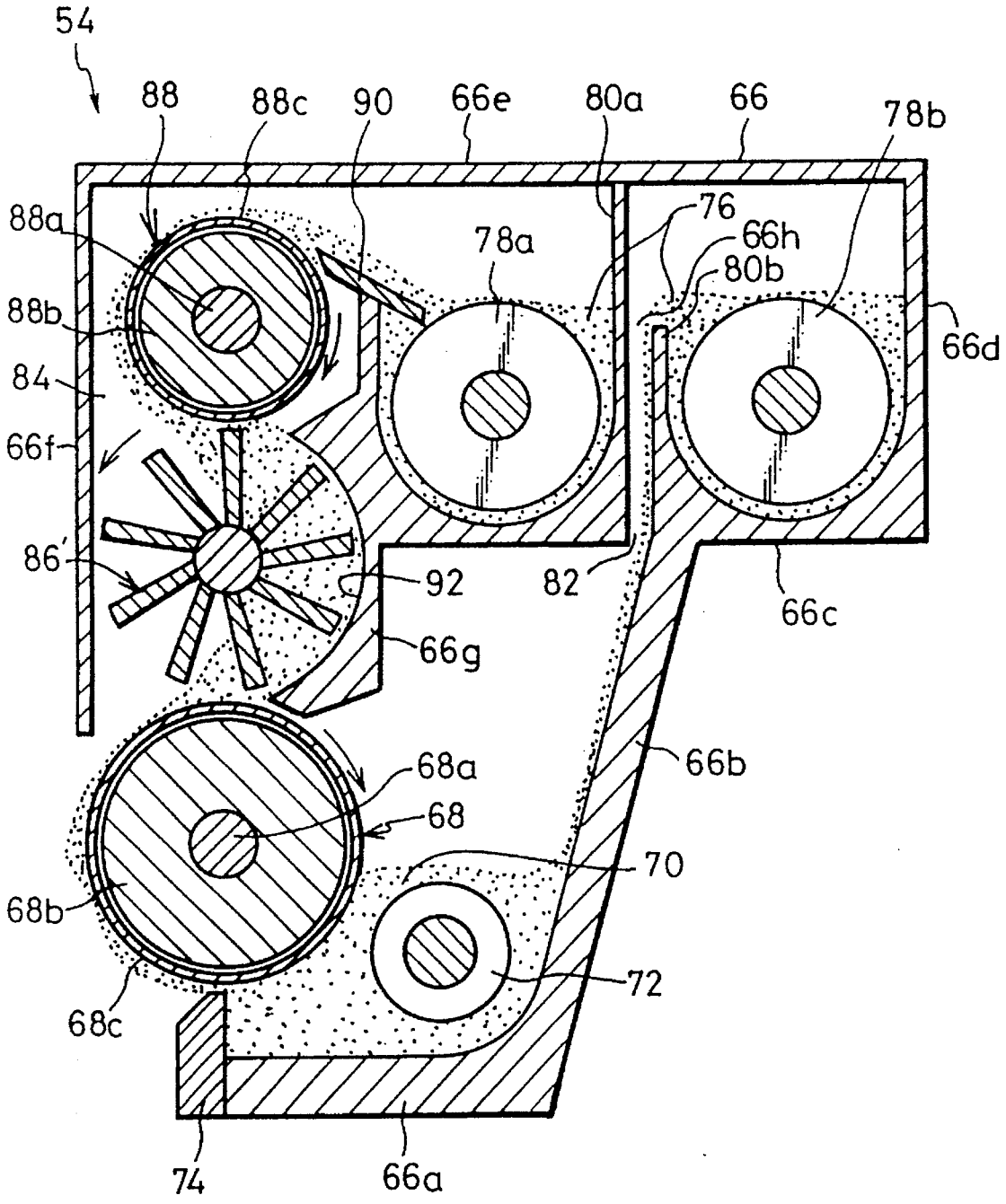
FIG. 6 is a transversely cross-sectional view showing an outline of a variation of the developing unit of the electrostatic recording unit shown in FIG. 5.
Figure 7:
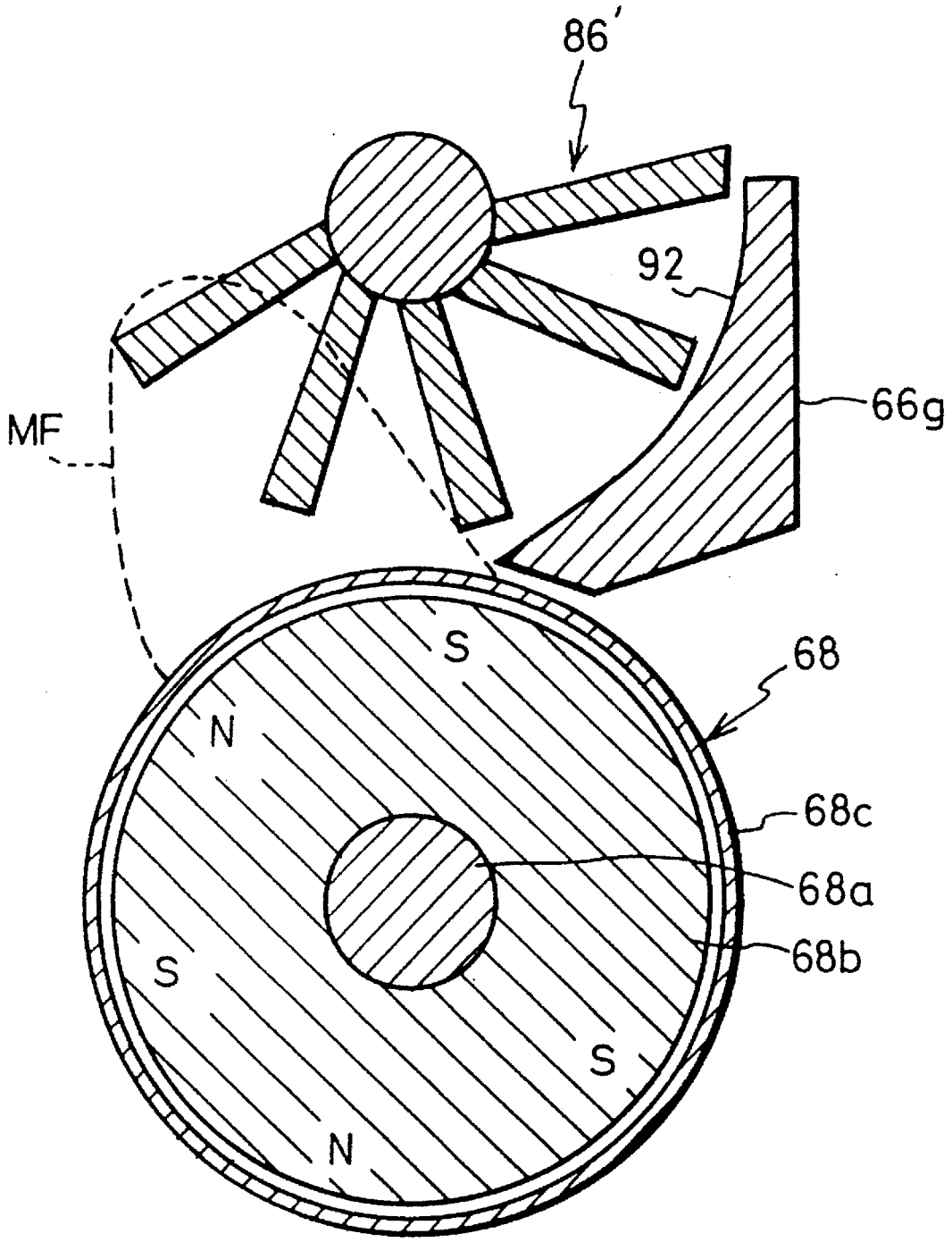
FIG. 7 is a partially enlarged view of the developing unit shown in FIG. 6.

In FIG. 6, there is shown a variation of the developing unit 54 illustrated in FIG. 5. In this variation, instead of the magnetic roller 86, a paddle wheel 86' is used for the mechanical developer lifting means. This paddle wheel 86' is rotatably supported by both wall portions of the developer holding container 66. In the process of operation of the developing unit 54, the paddle wheel 86' is rotated in the direction indicated by an arrow shown in the drawing. On the vertical partition wall portion 66*g*, there is formed a concave arcuate wall face 92 which is adapted for the paddle wheel 86'. The paddle wheel 86' pulls up the developer from the developing roller 68 in cooperation with the concave arcuate wall face 92, so that the developer is moved to the magnetic roller 88. In this connection, in FIG. 6, the developer is illustrated as an aggregation of fine spots. In order to effectively pull up the developer, a lower edge of the concave arcuate wall face 92 must be positioned as shown in FIG. 7. To explain in detail, the core portion 68*b* of the developing roller 68 is partially magnetized as shown in FIG. 7, and further a magnetic field MF is formed between the poles N and S adjacent to each other disposed on the side of the paddle wheel 86'. Under the condition described above, when the lower edge of the concave arcuate wall face 92 is positioned at a portion where the magnetic field disappears, the paddle wheel 86' is not affected by the magnetic field MF, so that the developer can be easily pulled up from the developing roller 68.

Figure 8:
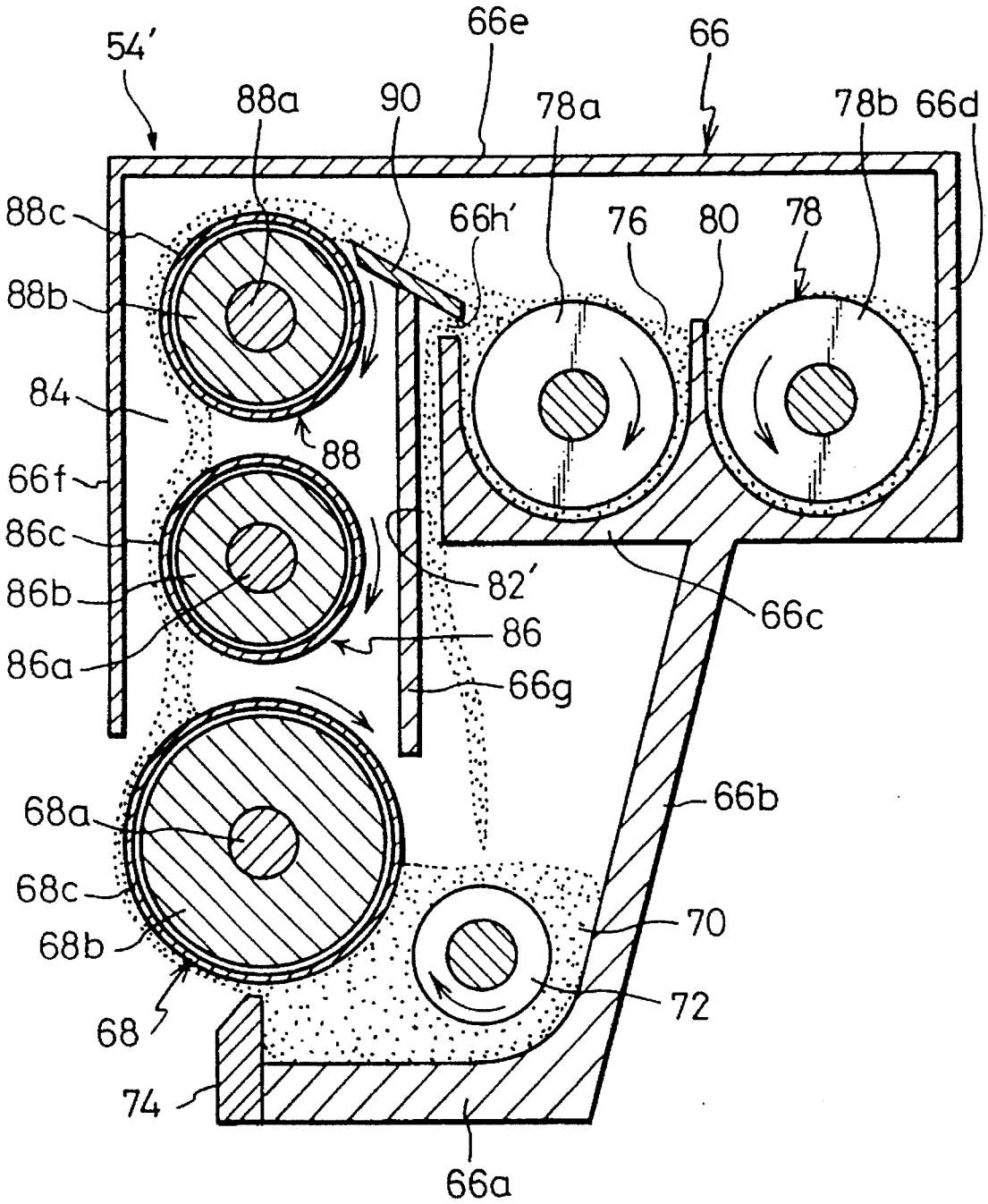
FIG. 8 is a transversely cross-sectional view showing an outline of another type developing unit capable of being used for the electrostatic recording unit shown in FIG. 5.
Figure 9:
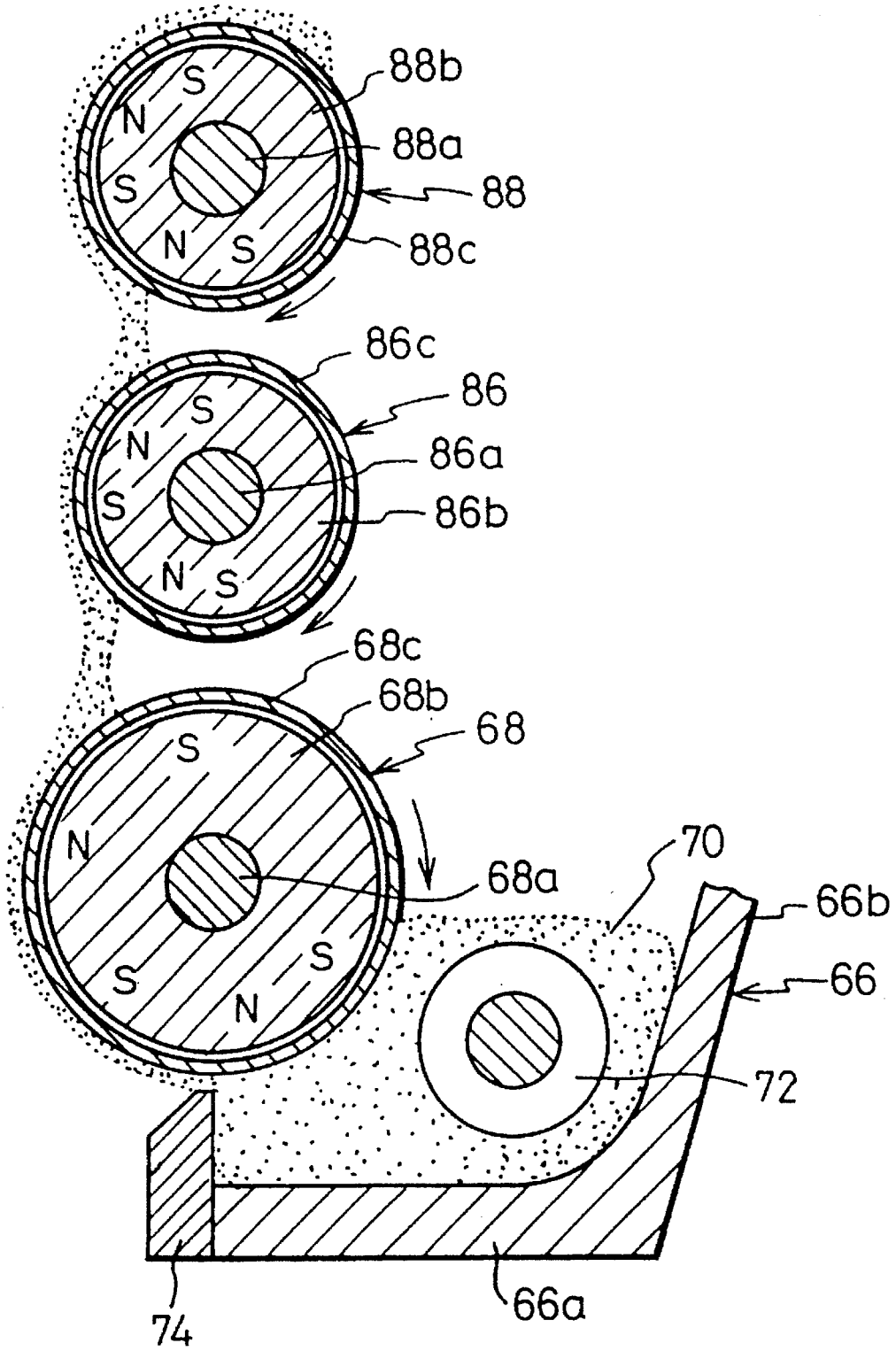
FIG. 9 is a partially enlarged view of the developing unit shown in FIG. 8.

In FIG. 8, there is shown a developing unit 54' which is different from the developing unit 54 illustrated in FIG. 5. In the same manner as that of the developing unit 54, it is possible to assemble this developing unit 54' into the electrostatic recording units Y, C, M and B illustrated in FIG. 4. In this connection, in FIG. 8, like parts in each of the drawings are identified by the same reference character. In the structure of the developing unit 54', the communication path 82 is eliminated from the second bottom wall portion 66*c* of the developer holding container 66, and a single partition plate 80 is disposed between the pair of conveyance screws 78*a* and 78*b*. On the other hand, the vertical partition wall portion 66*g* is separated from the front wall portion of the second bottom wall portion 66*c* and extends to the scraper member 90. There is provided a communication path 82' between the front wall portion of the second bottom wall portion 66*c* and the vertical partition wall portion 66*g*. This communication path 82' is communicated with the developer agitating potion 76 via an opening formed between an upper edge of the front wall portion of the second bottom wall portion 66*c* and the scraper member 90. This opening forms an overflow outlet 66*h'* with respect to the developer accommodated in the developer agitating portion 76. The core portions 86*b* and 88*b* of the magnetic rollers 86 and 88 are partially magnetized as shown in FIG. 9. As can be seen in FIGS. 8 and 9, due to the arrangement of magnetic poles described above, the developer is pulled up from the developing roller 68 and raised along the front sides of the magnetic rollers 86, 88. On the other hand, when the core portions 86*b*, 88*b* are magnetized as shown in FIG. 9, the developer overflows the developer overflow outlet 66*h'* and drops along the communication path 82'. At this time, the developer is not magnetically affected by the magnetic rollers 86 and 88, so that the developer can be smoothly supplied from the developer agitating portion 76 to the developer storage portion 70. In this connection, since the paddle wheel 86' shown in FIG. 6 has no magnetic influence upon the developer, it is possible to use the same paddle wheel 86' for the developing unit 54' shown in FIG. 8.

Figure 10:
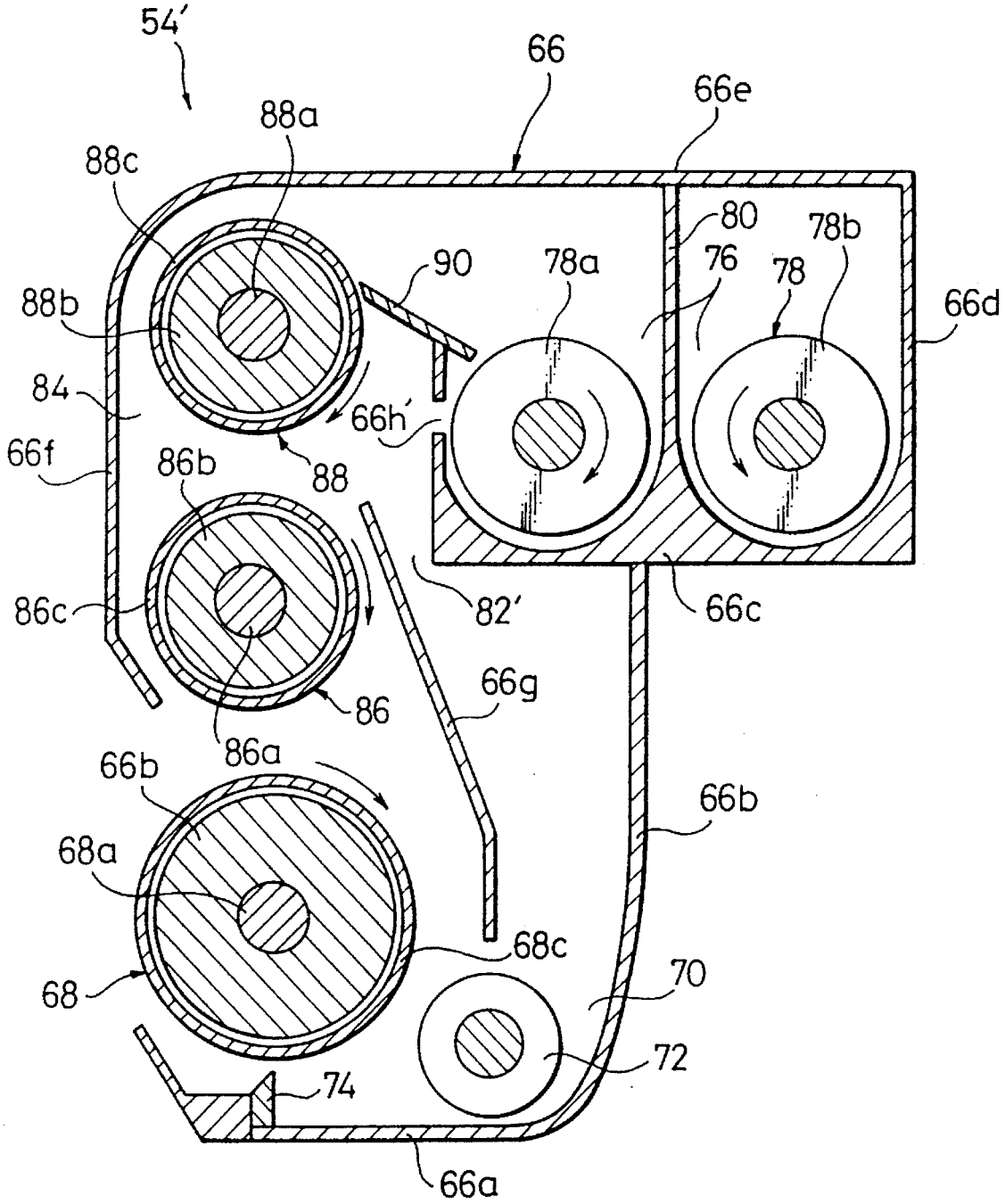

FIG. 10 is a view showing a variation of the developing unit 54' illustrated in FIGS. 8 and 9. It is possible to assemble this developing unit 54' into the electrostatic recording units Y, C, M and B shown in FIG. 4. In this connection, like parts in each of FIGS. 8, 9 and 10 are identified by the same reference character. In this variation, the front wall portion of the second bottom wall portion 66*c* extends to the scraper member 90, and a slit-shaped developer overflow outlet 66*h'* is formed on the front wall portion. As can be seen from FIG. 10, a lower edge of the developer overflow outlet 66*h* is located at the approximately same height as that of the rotational axis of the conveyance screw 78*a*. In this structure, the partition wall portion 66*g* is not extended to the scraper member 90. Therefore, the communication path 82' and the developer rising path 84 are communicated with each other at an upper edge of the partition wall portion 66*g*. In the same manner as that of the embodiment shown in FIG. 8, when the developer drops from the developer overflow outlet 66*h'* along the communication path 82', it is not magnetically affected by the magnetic rollers 86 and 88. Therefore, no developer is taken into the developer rising path 84.

In the embodiment shown in FIG. 10, a quantity of developer which overflows the developer overflow outlet 66*h'* fluctuates in accordance with the width of the developer overflow outlet 66*h'*. This quantity of developer which overflows the developer overflow outlet 66*h'* is also determined by a total quantity of developer held in the developing unit 54', that is, a quantity of developer held in the developer agitating portion 76. On the other hand, in order to develop an electrostatic latent image at a predetermined density, it is necessary that a predetermined quantity of developer is held in the developer storage portion 70, and also it is necessary that the developer held in the developer storage portion 70 is uniformly distributed in the axial direction of the developing roller 68 in the developer storage portion 70. The reason is that the development density of an electrostatic latent image is determined by a quantity of developer conveyed by the developing roller 68, and when the distribution of developer in the axial direction of the developing roller 68 is not uniform, the developing density fluctuates in the axial direction. Therefore, the inventors have made an investigation into a relation between the total quantity of developer held in the developing unit 54' and the width of the developer overflow outlet 66*h'*. Result of the investigation is shown on the following table.

| Width of overflow outlet | 1.5 to 2.5 | 3 | 4 | 5 | 6 | 7 | 8 |
|---|---|---|---|---|---|---|---|
| Maximum (kg) | x | 1.2 | 1.1 | 1.1 | 1.2 | 1.2 | 1.4 |
| Minimum (kg) | x | 1.3 | 1.6 | 2.0 | 2.0 | 2.0 | 2.0 |
| Distribution difference (mm) | 2 | 1 | 3 | 6 | 9 | 15 | 25 |

In this investigation, the conveyance screws 78*a* and 78*b* were used, the screw pitch of which was 37 mm, and the outer diameter of which was 27 mm.

As can be seen on the above table, in the case where the width of the developer overflow outlet was 3 mm, in order to obtain a quantity of developer to be accommodated in the developer storage portion 70 for the purpose of developing an electrostatic latent image at a predetermined density, it was necessary to provide a total quantity of developer of 1.2 kg at the minimum. However, when the total quantity of developer exceeded 1.3 kg, the developer overflowed in the developer agitating portion 76. That is, in the case where the width of the developer overflow outlet was 3 mm, the total quantity of developer to be held in the developing unit 54' was 1.2 kg to 1.3 kg. On the other hand, a difference of distribution of the developer accommodated in the developer storage portion 70 was approximately 1 mm.

In the case where the width of the developer overflow outlet was 4 mm, in order to obtain a quantity of developer to be accommodated in the developer storage portion 70 for the purpose of developing an electrostatic latent image at a predetermined density, it was necessary to provide a total quantity of developer of 1.1 kg at the minimum. However, when the total quantity of developer exceeded 1.6 kg, the developer overflowed in the developer agitating portion 76. That is, in the case where the width of the developer overflow outlet was 4 mm, the total quantity of developer to be held in the developing unit 54' was 1.1 kg to 1.6 kg. On the other hand, a difference of distribution of the developer accommodated in the developer storage portion 70 was approximately 3 mm.

In the case where the width of the developer overflow outlet was 5 mm, in order to obtain a quantity of developer to be accommodated in the developer storage portion 70 for the purpose of developing an electrostatic latent image at a predetermined density, it was necessary to provide a total quantity of developer of 1.1 kg at the minimum. However, when the total quantity of developer exceeded 2.0 kg, the developer overflowed in the developer agitating portion 76. That is, in the case where the width of the developer overflow outlet was 5 mm, the total quantity of developer to be held in the developing unit 54' was 1.1 kg to 2.0 kg. On the other hand, a difference of distribution of the developer accommodated in the developer storage portion 70 was approximately 6 mm.

In the case where the widths of the developer overflow outlet were 6 and 7 mm, in order to obtain a quantity of developer to be accommodated in the developer storage portion 70 for the purpose of developing an electrostatic latent image at a predetermined density, it was necessary to provide a total quantity of developer of 1.2 kg at the minimum in both cases. However, when the total quantity of developer exceeded 2.0 kg, the developer overflowed in the developer agitating portion 76. That is, in the case where the widths of the developer overflow outlet were 5 and 7 mm, the total quantities of developer to be held in the developing unit 54' were 1.2 to 2.0 kg. On the other hand, a difference of distribution of the developer accommodated in the developer storage portion 70 was approximately 9 mm in the case where the width of the developer overflow outlet was 6 mm, and a difference of distribution of the developer accommodated in the developer storage portion 70 was approximately 15 mm in the case where the width of the developer overflow outlet was 7 mm.

In the case where the width of the developer overflow outlet was 8 mm, in order to obtain a quantity of developer to be accommodated in the developer storage portion 70 for the purpose of developing an electrostatic latent image at a predetermined density, it was necessary to provide a total quantity of developer of 1.4 kg at the minimum. However, when the total quantity of developer exceeded 2.0 kg, the developer overflowed in the developer agitating portion 76. That is, in the case where the width of the developer overflow outlet was 8 mm, the total quantity of developer to be held in the developing unit 54' was 1.4 kg to 2.0 kg. On the other hand, a difference of distribution of the developer accommodated in the developer storage portion 70 was approximately 25 mm.

In the case where the width of the developer overflow outlet was 1.5 to 25 mm, it was impossible to provide a quantity of developer necessary for developing an electrostatic latent image at a predetermined density in the developer storage portion 70, irrespective of the total quantity of the developer accommodated in the developing unit 54'.

It was found that a difference of development density was caused in the axial direction of the developing roller 68 when a difference of distribution of the developer in the developer storage portion 70 exceeded about 20 mm. Accordingly, in the case of the conveyance screws **78*a*, 78*b*, the outer diameters of which are 27 mm, it is preferable that the width of the developer overflow outlet is determined to be approximately 3 to 7 mm. That is, it is necessary that the width of the developer overflow outlet is determined to be at least not less than 1/9 of the outer diameters of the conveyance screws 78*a*, 78*b*, and further the width of the developer overflow outlet must be determined to be not more than 7/27 of the outer diameters of the conveyance screws 78*a*, 78*b***.

In order to accomplish a high speed recording by the multicolor electrostatic recording apparatus shown in FIG. 4, it is necessary that the toner component is continuously replenished to the developer accommodated in each developing unit 54 in the process of recording. The reason is that the toner component in the developer accommodated in each developing unit 54 is quickly consumed. There is shown a toner replenishing container 64 in FIGS. 11 and 12, which includes a toner replenishing portion **64*a* and a developer supplying portion 64*b*. Only the toner component is accommodated in the toner replenishing portion 64*a*, and the developer containing the toner and magnetic carrier components is accommodated in the developer supplying portion 64*b*. The toner replenishing portion 64*a* is provided with a replenishing port 64*a*', and the developer supplying portion 64*b* is provided with a supplying port 64*b*'. When the toner replenishing container 64 is mounted on the developer holding container 66 of the developing unit 54, the replenishing port 64*a*' and the supplying port 64*b*' are respectively connected with the connection ports 66*i* and 66*j* (shown in FIG. 5) provided on the top wall portion 66*e* of the developer holding container 66**.

When the developer held in the developing unit 54 is deteriorated, all the developer is replaced with new one. Specifically, first, the developer in the developing unit 54 is ejected from the developer ejection port **66*k* provided on the second bottom wall 66*c*. Then, new developer is supplied from the developer supply portion 64*a* of the toner replenishing container 64 into the developer holding container 66 via the supply port 64*b*'**.

Figure 11:
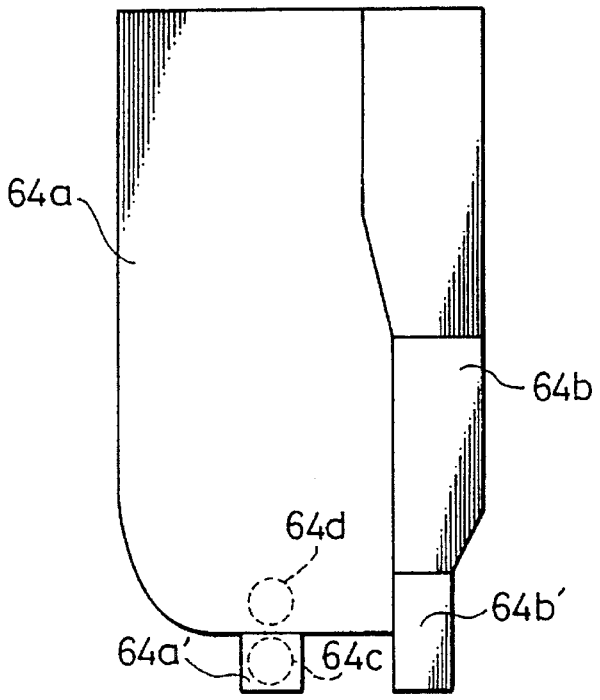
FIG. 11 is a side view showing a toner replenishing container.
Figure 12:
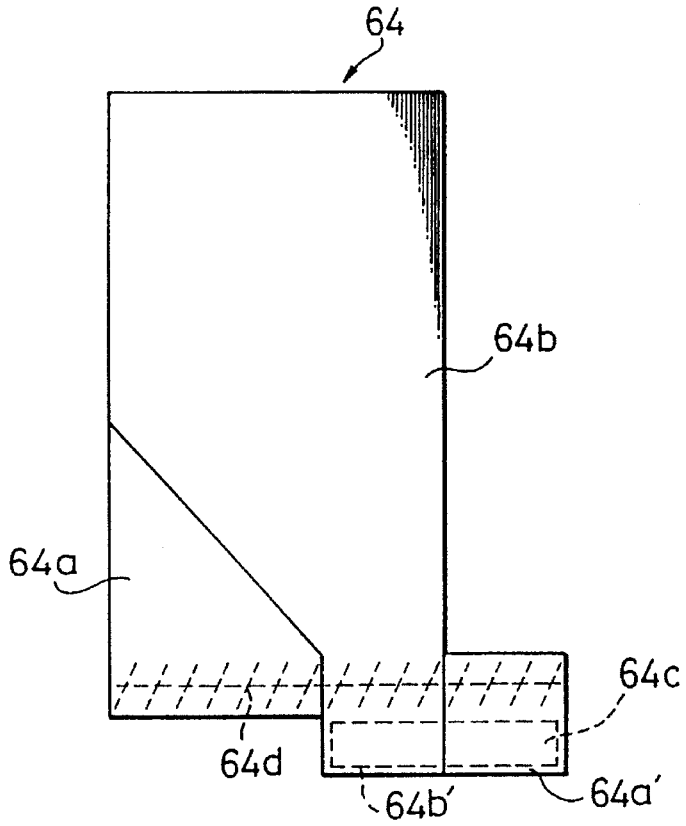
FIG. 12 is a front view showing a toner replenishing container.
Figure 13:
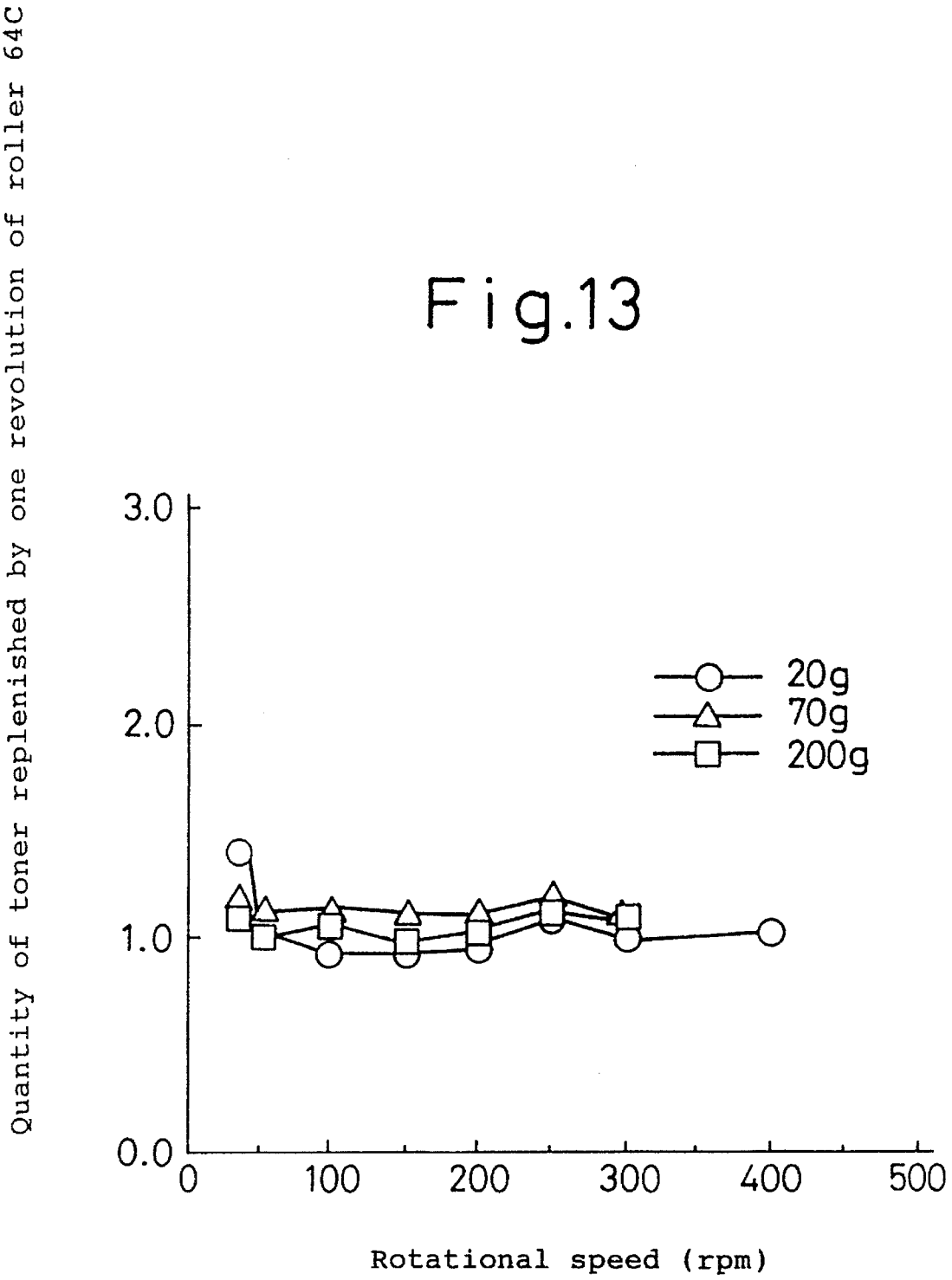
FIG. 13 is a graph showing the relationship between the rotational speed of a sponge roller arranged at a replenishing port of the toner replenishing container and a quantity of toner replenished by one revolution of the sponge roller.

On the other hand, while recording operation is conducted in the multicolor electrostatic recording apparatus, a predetermined quantity of toner component is replenished from the toner replenishing portion **64*a* of the toner replenishing container 64 into the developer holding container 66 via the replenishing port 64*a*'. As shown in FIGS. 11 and 12, in the replenishing port 64*a*', there is provided a sponge roller 64*c* for replenishing the toner component. At the bottom of the toner replenishing portion 64*a*, there is provided a toner conveyance screw 64*d* for replenishing the toner component to the replenishing port 64*a*'. A quantity of toner replenished by the sponge roller 64*c* is determined by the quantity of the toner component accommodated in the toner replenishing portion 64*a* and the rotational speed of the sponge roller 64*c*. For example, in the case of the sponge roller 64*c*, the diameter of which was 16 mm, and the length of which was 86 mm, a quantity of toner replenished by one revolution of the sponge roller 64*c* was investigated. The results of the investigation are shown on the graph of FIG. 13. As can be seen from the graph, when the sponge roller 64*c* was rotated at a rotational speed of not less than 100 rpm, the quantity of toner replenished by one revolution of the sponge roller 64***c* was approximately 1 g irrespective of a quantity of the toner component accommodated in the toner replenishing portion 64*a*. That is, when the sponge roller 64*c* was rotated at a rotational speed not less than 100 rpm, the quantity of toner replenished by one revolution of the sponge roller 64*c* was maintained approximately at 1 g irrespective of a quantity of the toner component remaining in the toner replenishing portion 64*a*.

In this connection, in this embodiment, the developer replenishing portion 64*a* is additionally attached to the toner replenishing container 64, however, it should be noted that the developer replenishing portion 64*a* may be provided as an independent container.

In this connection, a quantity of toner consumed in the process of recording by the multicolor electrostatic recording apparatus is expressed by the following equation.

Quantity of toner consumption (g/s)=[Surface speed (cm/s) of photoreceptor drum]×[Recording width (cm)]×[Development ratio (%)×0.01]×[Quantity of toner used for development ($g/cm^2$)]

On the other hand, a quantity of replenished toner is expressed by the following equation.

Quantity of replenished toner (g/s)=[Length of roller 64*c* (cm)]×[Surface speed (cm/s) of roller 64*c*]×[Quantity of replenished toner ($g/cm^2$) per unit area]

Accordingly, while recording operation is conducted by the multicolor electrostatic recording apparatus, toner must be replenished so that the following equation can be satisfied.

[Quantity of replenished toner (g/s)]≧Quantity of consumed toner (g/s)

For example, operation is conducted under the following conditions. Surface speed of the photoreceptor drum 48 is 24 cm/s; recording width is 30 cm; development ratio is 10%; quantity of toner used for development is 0.0007 $g/cm^2$; diameter of the sponge roller 64*c* is 16 mm; and its rotational speed is 100 rpm. In the above case, length of the sponge roller 64*c* must be at least 2.6 mm. Of course, when the diameter of the sponge roller 64*c* is not less than 16 mm, it is possible to reduce the length of the sponge roller 64*c* in accordance with the diameter.

Figure 14:
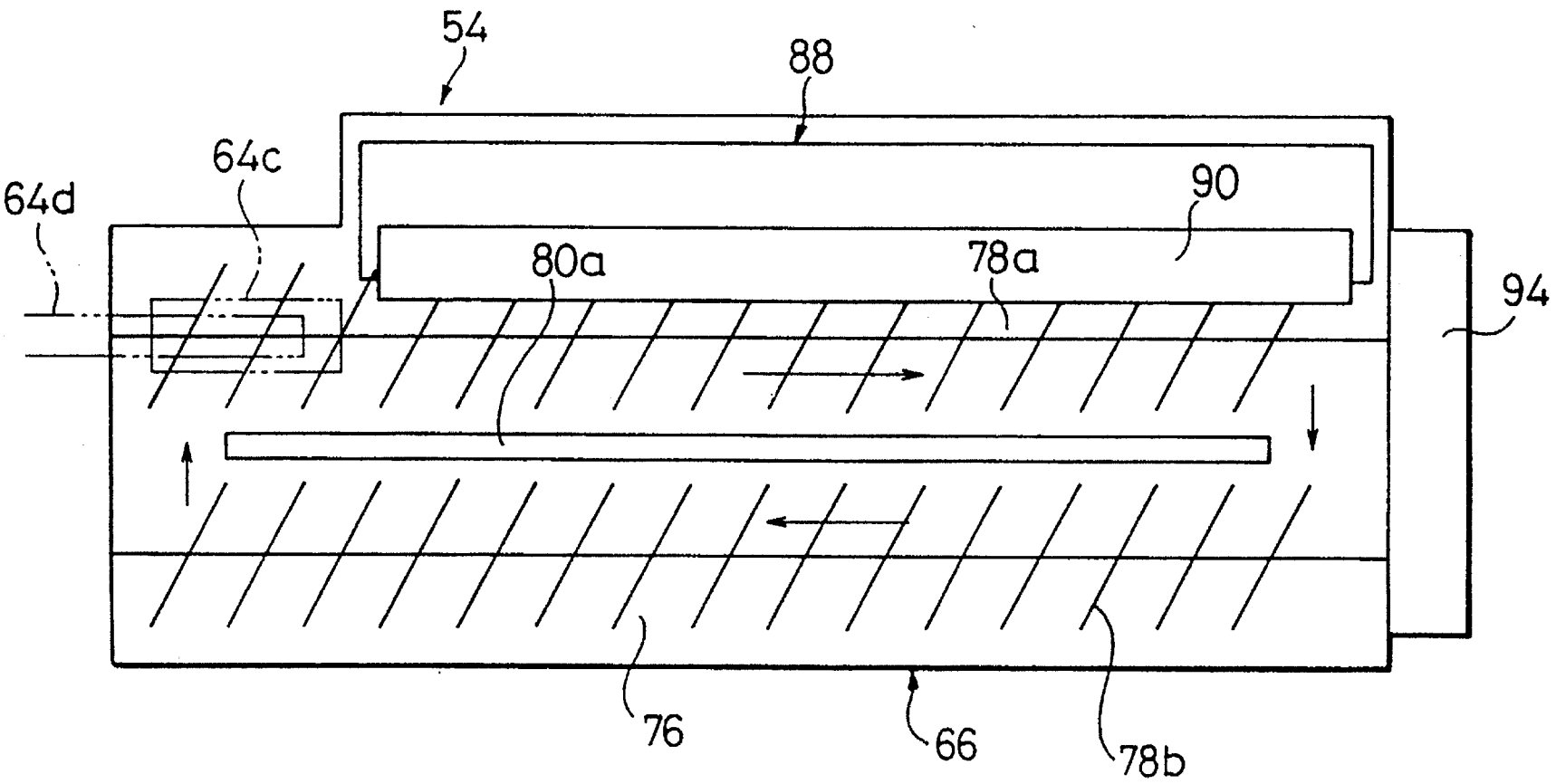
FIG. 14 is a plan view schematically showing the developing unit shown in FIG. 5.
Figure 15:
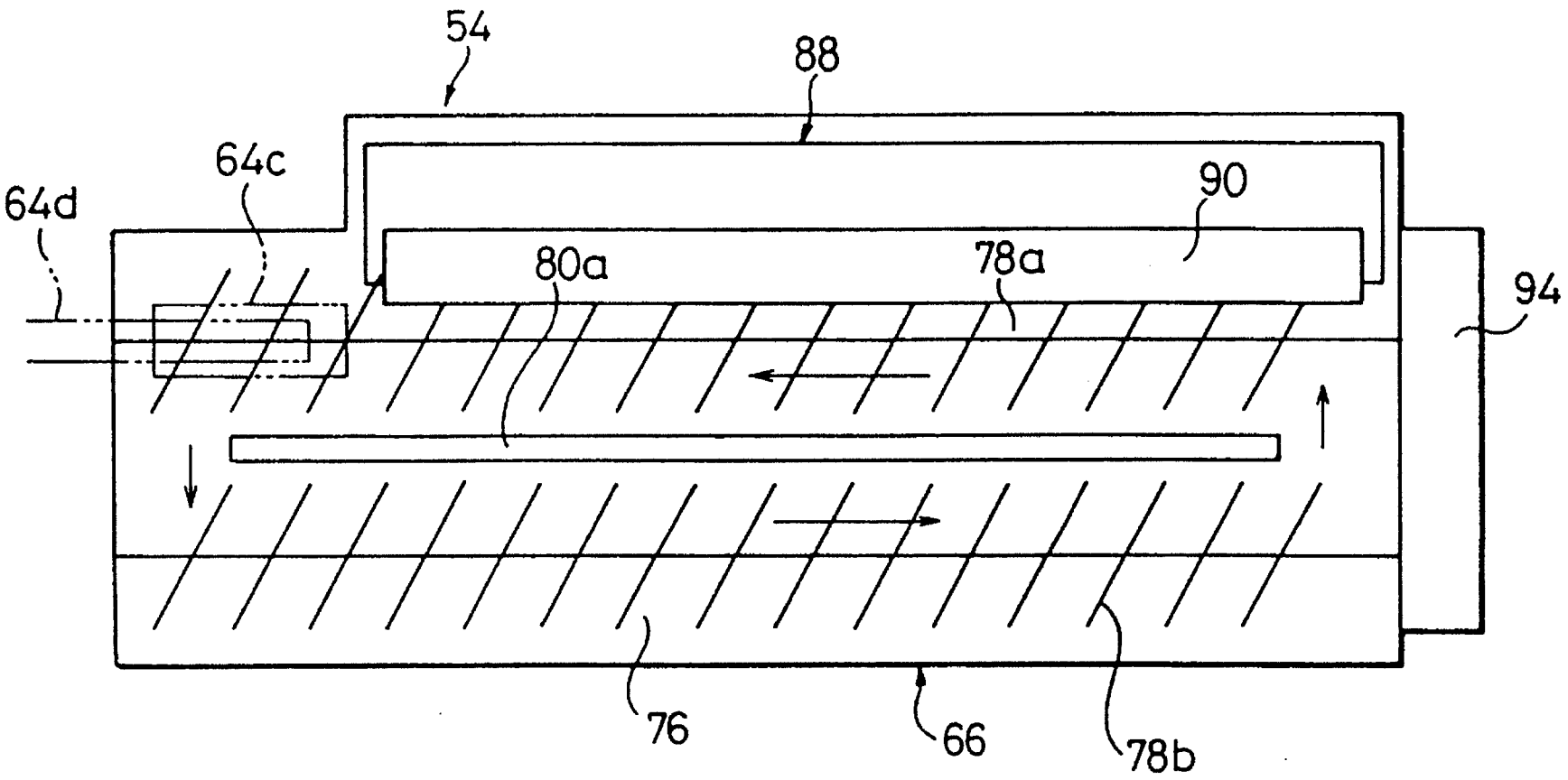
FIG. 15 is a plan view schematically showing the developing unit shown in FIGS. 8 and 10.

It is necessary that the toner component replenished to the developer agitating portion 76 is supplied to the developer storage portion 70 after it has been sufficiently charged triboelectrically. FIG. 14 is a schematic plan view of the developing unit 54. In FIG. 14, the sponge roller 64*c* and the toner conveyance screw 64*d* are illustrated by two-dotted chain lines. In this case, in the developer agitating portion 76, developer must be circulated in the direction shown by the arrow in the drawing. That is, the toner component replenished at the position of the sponge roller 64*c* is agitated by the conveyance screw 78*a* so that the toner component is sufficiently charged. After that, the toner component is moved to the conveyance screw 78*b* and supplied to the developer storage portion 70 via the developer overflow outlet 66*h* (FIG. 4). In the cases of the developing units 54' shown in FIGS. 8 and 10, developer must be circulated in the reverse direction as shown in FIG. 15. That is, the toner component replenished at the position of the sponge roller 64*c* is agitated by the conveyance screw 78*b* so that the toner component is sufficiently charged. After that, the toner component is moved to the conveyance screw 78*a* and supplied to the developer storage portion 70 via the developer overflow outlet 66*h*' (FIG. 8, FIG. 10).

As shown in FIGS. 14 and 15, on one of the side walls of the developer holding container 66, there is provided a gear box 94 used for driving the developing roller 68, the conveyance screws 78*a*, 78*b* and the magnetic rollers 86, 88. The toner replenishing container 64 is disposed on the opposite side to the gear box 94. Accordingly, it is necessary to determine the developer circulating direction in the developer agitating portion 76 according to the positions of the developer overflow outlets 66*h*, 66*h*'.

Figure 16:
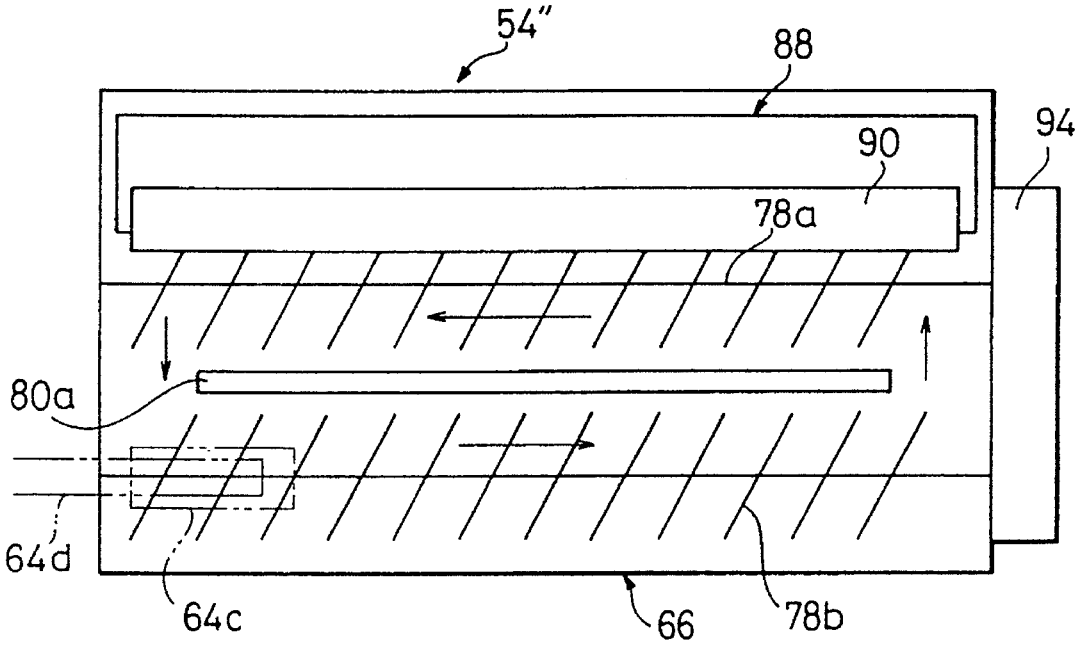
FIG. 16 is a plan view schematically showing a developing unit corresponding to the developing unit shown in FIGS. 8 and 10.
Figure 17:
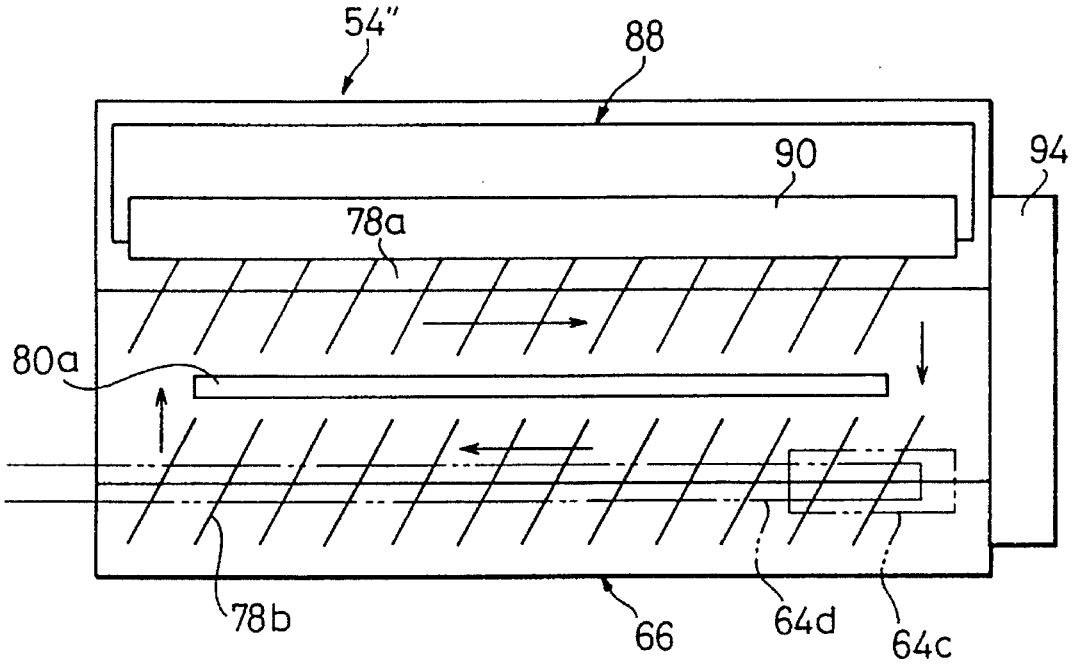
FIG. 17 is a plan view schematically showing a developing unit corresponding to the developing unit shown in FIGS. 8 and 10.

In the embodiments shown in FIGS. 14 and 15, the length of the developer agitating portion 76 of the developer holding container 66 is extended longer than the length of the developing roller 68, and the toner replenishing container 64 is attached to the extended portion. However, it is possible to compose the apparatus in such a manner that the length of the developer agitating portion 76 corresponds to the length of the developing roller 68 as shown in FIGS. 16 and 17. In this connection, the developing units 54" shown in FIGS. 16 and 17 correspond to the developing units 54' shown in FIGS. 8 and 10. In this case, when the sponge roller 64*c* is disposed at the position indicated by the two-dotted line, the replenished toner is supplied to the developer storage 70 via the developer overflow outlet 66*h*' after the toner component has been sufficiently charged. When the apparatus is composed in such a manner that the developing units 54" shown in FIG. 16 and 17 correspond to the developing unit 54 shown in FIG. 5, the circulating direction of developer in the developer agitating portion 76 is reversed.

As can be seen in the above descriptions, it is possible to reduce the size of the entire structure of the multicolor electrostatic recording apparatus of the present invention. Therefore, the installation area of the multicolor electrostatic recording apparatus can be reduced. By the multicolor electrostatic recording apparatus of the present invention, formation of images of high quality can be guaranteed even when image formation is conducted at high speed.

We claim:

1. A multicolor electrostatic recording apparatus comprising a plurality of electrostatic recording units disposed in series along a recording medium movement path, each electrostatic recording unit comprising:

an electrostatic latent image carrier disposed in the recording medium movement path; a developing means provided in the upstream of the recording medium movement path with respect to the electrostatic latent image carrier; and a cleaning means provided in the downstream of the recording medium movement path with respect to the electrostatic latent image carrier, the developing means having a developer holding container including a developer storage portion and a developer agitating portion disposed at an upper position of the developer storage portion, the developer agitating portion being connected with the developer storage portion via a communicating path, so that a portion of the developer held in the developer agitating portion is successively supplied to the developer storage portion, the developing means further including a developer carrier provided in the developer storage portion, the developer carrier being partially exposed so that the developer carrier can be opposed to the electrostatic latent image carrier, and the developer carrier conveys developer from the developer storage portion to an opposing region in which the developer carrier is opposed to the electrostatic latent image carrier so as to develop an electrostatic latent image on the electrostatic latent image carrier, and the developing means further including a developer lifting means for lifting the developer conveyed to the opposing region by the developer carrier to the developer agitating portion of the developer holding container, characterized in that the cleaning unit of one of the two adjacent electrostatic recording units is disposed being adjacent to the developer storage portion of the developer holding container which forms a portion of the developing means of the other electrostatic recording unit; and wherein a cleaning means of one of the two adjacent electrostatic recording units is adjacent to the developer storage portion of the developer holding container comprising a portion of the developing means of the other electrostatic recording unit and disposed under the developer agitating portion.

2. The multicolor electrostatic recording apparatus according to claim 1, wherein the developer lifting means comprises at least one magnetic roller.

3. A multicolor electrostatic recording apparatus, comprising a plurality of electrostatic recording units disposed in series along a recording medium movement path, each electrostatic recording unit comprising:

an electrostatic latent image carrier disposed in the recording medium movement path; a developing means provided in the upstream of the recording medium movement path with respect to the electrostatic latent image carrier; and a cleaning means provided in the downstream of the recording medium movement path with respect to the electrostatic latent image carrier, the developing means having a developer holding container including a developer storage portion and a developer agitating portion disposed at an upper position of the developer storage portion, the developer agitating portion being connected with the developer storage portion via a communicating path, so that a portion of the developer held in the developer agitating portion is successively supplied to the developer storage portion, the developing means further including a developer carrier provided in the developer storage portion, the developer carrier being partially exposed so that the developer carrier can be opposed to the electrostatic latent image carrier, and the developer carrier conveys developer from the developer storage portion to an opposing region in which the developer carrier is opposed to the electrostatic latent image carrier so as to develop an electrostatic latent image on the electrostatic latent image carrier, and the developing means further including a developer lifting means for lifting the developer conveyed to the opposing region by the developer carrier to the developer agitating portion of the developer holding container, characterized in that the cleaning unit of one of the two adjacent electrostatic recording units is disposed being adjacent to the developer storage portion of the developer holding container which forms a portion of the developing means of the other electrostatic recording unit; and wherein the developer lifting means comprises a mechanical developer lifting means disposed above the developer carrier and a magnetic roller disposed above the mechanical developer lifting means.

4. The multicolor electrostatic recording apparatus according to claim 3, wherein the mechanical developer lifting means comprises a paddle wheel (86'), and the paddle wheel is arranged so that the paddle wheel can lift up developer from the developer carrier (68) at a position where the magnetic field of the developer carrier disappears.

5. A multicolor electrostatic recording apparatus, comprising a plurality of electrostatic recording units disposed in series along a recording medium movement path, each electrostatic recording unit comprising:

an electrostatic latent image carrier disposed in the recording medium movement path; a developing means provided in the upstream of the recording medium movement path with respect to the electrostatic latent image carrier; and a cleaning means provided in the downstream of the recording medium movement path with respect to the electrostatic latent image carrier, the developing means having a developer holding container including a developer storage portion and a developer agitating portion disposed at an upper position of the developer storage portion, the developer agitating portion being connected with the developer storage portion via a communicating path, so that a portion of the developer held in the developer agitating portion is successively supplied to the developer storage portion, the developing means further including a developer carrier provided in the developer storage portion, the developer carrier being partially exposed so that the developer carrier can be opposed to the electrostatic latent image carrier, and the developer carrier conveys developer from the developer storage portion to an opposing region in which the developer carrier is opposed to the electrostatic latent image carrier so as to develop an electrostatic latent image on the electrostatic latent image carrier, and the developing means further including a developer lifting means for lifting the developer conveyed to the opposing region by the developer carrier to the developer agitating portion of the developer holding container, characterized in that the cleaning unit of one of the two adjacent electrostatic recording units is disposed being adjacent to the developer storage portion of the developer holding container which forms a portion of the developing means of the other electrostatic recording unit; and the developer agitating means comprising: a first developer conveyance screw arranged in the developer agitating portion of the developer holding container in the longitudinal direction of the developer carrier; a second developer conveyance screw arranged in parallel to the first developer conveyance screw on a side opposite to the developer carrier; a first partition plate arranged between the first and the second developer conveyance screw on a side of the first developer conveyance screw; and a second partition plate arranged between the first and the second developer conveyance screw on a side of the second developer conveyance screw, wherein the first and the second developer conveyance screw are respectively driven in the directions opposite to each other so as to circulate developer in the developer agitating portion, and a developer overflow outlet of the communication path is formed by the first and the second partition plate.

6. A multicolor electrostatic recording apparatus, comprising a plurality of electrostatic recording units disposed in series along a recording medium movement path, each electrostatic recording unit comprising:

an electrostatic latent image carrier disposed in the recording medium movement path; a developing means provided in the upstream of the recording medium movement path with respect to the electrostatic latent image carrier; and a cleaning means provided in the downstream of the recording medium movement path with respect to the electrostatic latent image carrier, the developing means having a developer holding container including a developer storage portion and a developer agitating portion disposed at an upper position of the developer storage portion, the developer agitating portion being connected with the developer storage portion via a communicating path, so that a portion of the developer held in the developer agitating portion is successively supplied to the developer storage portion, the developing means further including a developer carrier provided in the developer storage portion, wherein the developer carrier is partially exposed so that the developer carrier can be opposed to the electrostatic latent image carrier, and the developer carrier conveys developer from the developer storage portion to an opposing region in which the developer carrier is opposed to the electrostatic latent image carrier so as to develop an electrostatic latent image on the electrostatic latent image carrier, and the developing means further including a developer lifting means for lifting the developer conveyed to the opposing region by the developer carrier to the developer agitating portion of the developer holding container, characterized in that a space is formed by the developer holding container when the developer agitating portion is partially protruded onto a rear side of the developer storage portion, and a cleaning means of one of the two adjacent electrostatic recording units is accommodated in the space formed by the developer holding container composing a portion of the developing means of the other electrostatic recording unit; and wherein the developer lifting means is composed of a mechanical developer lifting means arranged above the developer carrier and a magnetic roller arranged above the mechanical developer lifting means.

7. The multicolor electrostatic recording apparatus according to claim 6, wherein the mechanical developer lifting means is composed of a paddle wheel (86') arranged so that the paddle wheel can lift up developer from the developer carrier (68) at a position where the magnetic field of the developer carrier disappears.

8. A multicolor electrostatic recording apparatus, comprising a plurality of electrostatic recording units disposed in series along a recording medium movement path, each electrostatic recording unit comprising:

an electrostatic latent image carrier disposed in the recording medium movement path; a developing means provided in the upstream of the recording medium movement path with respect to the electrostatic latent image carrier; and a cleaning means provided in the downstream of the recording medium movement path with respect to the electrostatic latent image carrier, the developing means having a developer holding container including a developer storage portion and a developer agitating portion disposed at an upper position of the developer storage portion, the developer agitating portion being connected with the developer storage portion via a communicating path, so that a portion of the developer held in the developer agitating portion is successively supplied to the developer storage portion, the developing means further including a developer carrier provided in the developer storage portion, wherein the developer carrier is partially exposed so that the developer carrier can be opposed to the electrostatic latent image carrier, and the developer carrier conveys developer from the developer storage portion to an opposing region in which the developer carrier is opposed to the electrostatic latent image carrier so as to develop an electrostatic latent image on the electrostatic latent image carrier, and the developing means further including a developer lifting means for lifting the developer conveyed to the opposing region by the developer carrier to the developer agitating portion of the developer holding container, characterized in that a space is formed by the developer holding container when the developer agitating portion is partially protruded onto a rear side of the developer storage portion, and a cleaning means of one of the two adjacent electrostatic recording units is accommodated in the space formed by the developer holding container composing a portion of the developing means of the other electrostatic recording unit; and the developer agitating means comprising: a first developer conveyance screw arranged in the developer agitating portion of the developer holding container in the longitudinal direction of the developer carrier 68; a second developer conveyance screw arranged in parallel to the first developer conveyance screw on a side opposite to the developer carrier; a first partition plate arranged between the first and the second developer conveyance screw on a side of the first developer conveyance screw; and a second partition plate arranged between the first and the second developer conveyance screw on a side of the second developer conveyance screw, wherein the first and the second developer conveyance screw are driven in the directions opposite to each other so as to circulate developer in the developer agitating portion, and a developer overflow outlet of the communication path is formed by the first and the second partition plates.

9. A developing unit for developing an electrostatic latent image with two-component developer, comprising:

a developer holding container (66) comprising a developer storage portion (70) and a developer agitating portion (76) disposed above the developer storage portion, wherein a communicating path (84, 84') is formed between the developer agitating portion and the developer storage portion, and the communicating path is open to the developer agitating portion so that a developer overflow outlet (**66*h*, 66*h'***) can be formed;

a developer carrier (68) arranged in the developer storage portion of the developer holding container, wherein the developer carrier is partially exposed so that the developer carrier can be opposed to an electrostatic latent image carrier (48), and the developer carrier conveys developer from the developer storage portion to an opposing region in which the developer carrier is opposed to the electrostatic latent image carrier so as to develop an electrostatic latent image on the electrostatic latent image carrier;

a developer lifting means (86, 88, 86') for lifting up the developer conveyed to the opposing region by the developer carrier to the developer agitating portion of the developer holding container;

a developer agitating means (78*a*, 78*b*) for agitating the developer in the developer agitating portion of the developer holding container, wherein a portion of the developer agitated by this developer agitating means is supplied to the developer storage portion via the developer overflow outlet and the communicating path; and a toner replenishing means (64) for replenishing a toner component to the developer agitating portion, characterized in that the toner replenishing means is positioned with respect to the developer agitating portion (76) so that the replenished toner component can reach the developer overflow outlet (66*h*) after the replenished toner component has been sufficiently agitated by the developer agitating means so as to be triboelectrically charged.

10. The developing unit according to claim 9, wherein the communicating path (64) is arranged adjacent to the developer lifting means (86, 88, 86').

11. The developing unit according to claim 9 or 10, wherein the developer lifting means comprises at least one magnetic roller (86, 88), and the developer lifting means is arranged so that the magnetic poles can be raised along the exposed side of the developer carrier (68).

12. The developing unit according to claim 11, the toner replenishing means (64) including: a toner accommodating portion (64*a*) for accommodating the toner component; a replenishing outlet (64*a'*) provided in the toner accommodating portion; and a sponge roller (64*c*) for replenishing toner disposed at the replenishing outlet, wherein the sponge roller for replenishing toner is rotated so that a quantity of toner replenished per unit hour can be made substantially constant irrespective of a quantity of residual toner in the toner accommodating portion.

13. A developing unit, for developing an electrostatic latent image with two-component developer, comprising:

a developing holding container comprising a developer storage portion and a developer agitating portion disposed above the developer storage portion, wherein a communicating path is formed between the developer agitating portion and the developer storage portion, and the communicating path is open to the developer agitating portion so that a developer overflow outlet can be formed;

a developer carrier arranged in the developer storage portion of the developer holding container, wherein the developer carrier is partially exposed so that the developer carrier can be opposed to an electrostatic latent image carrier, and the developer carrier conveys developer from the developer storage portion to an opposing region in which the developer carrier is opposed to the electrostatic latent image carrier so as to develop an electrostatic latent image on the electrostatic latent image carrier;

a developer lifting means for lifting up the developer conveyed to the opposing region by the developer carrier to the developer agitating portion of the developer holding container;

a developer agitating means for agitating the developer in the developer agitating portion of the developer holding container, wherein a portion of the developer agitated by this developer agitating means is supplied to the developer storage portion via the developer overflow outlet and the communicating path; and a toner replenishing means for replenishing a toner component to the developer agitating portion, characterized in that the toner replenishing means is positioned with respect to the developer agitating portion so that the replenished toner component can reach the developer overflow outlet after the replenished toner component has been sufficiently agitated by the developer agitating means so as to be triboelectrically charged; and wherein the developer lifting means comprises a mechanical developer lifting means arranged above the developer carrier and a magnetic roller arranged above the mechanical developer lifting means.

14. The developing unit according to claim 13, wherein the mechanical developer lifting means comprises a paddle wheel (86') arranged so that the paddle wheel can lift up developer from the developer carrier (68) at a position where the magnetic field of the developer carrier disappears.

15. A developing unit, for developing an electrostatic latent image with two-component developer, comprising:

a developing holding container comprising a developer storage portion and a developer agitating portion disposed above the developer storage portion, wherein a communicating path is formed between the developer agitating portion and the developer storage portion and the communicating path is open to the developer agitating portion so that a developer overflow outlet can be formed;

a developer carrier arranged in the developer storage portion of the developer holding container, wherein the developer carrier is partially exposed so that the developer carrier can be opposed to an electrostatic latent image carrier, and the developer carrier conveys developer from the developer storage portion to an opposing region in which the developer carrier is opposed to the electrostatic latent image carrier so as to develop an electrostatic latent image on the electrostatic latent image carrier;

a developer lifting means for lifting up the developer conveyed to the opposing region by the developer carrier to the developer agitating portion of the developer holding container;

a developer agitating means for agitating the developer in the developer agitating portion of the developer holding container, wherein a portion of the developer agitated by this developer agitating means is supplied to the developer storage portion via the developer overflow outlet and the communicating path; and a toner replenishing means for replenishing a toner component to the developer agitating portion, characterized in that the toner replenishing means is positioned with respect to the developer agitating portion so that the replenished toner component can reach the developer overflow outlet after the replenished toner component has been sufficiently agitated by the developer agitating means so as to be triboelectrically charged; and wherein the communicating path is located approximately at the center of the developer agitating portion of the developer holding container, the developer lifting means comprises at least 2 magnetic rollers, and magnetic poles of the magnetic rollers are arranged so that the developer pulled up from the developer carrier can be raised in an S-shaped path.

16. The developing unit according to one of claims 12, 13 and 15, the toner replenishing means (64) including: a toner accommodating portion (64*a*) for accommodating the toner component; a replenishing outlet (64*a'*) provided in the toner accommodating portion; and a sponge roller (64*c*) for replenishing toner disposed at the replenishing outlet, wherein the sponge roller for replenishing toner is rotated so that a quantity of toner replenished per unit hour can be made substantially constant irrespective of a quantity of residual toner in the toner accommodating portion.

17. A developing unit for developing an electrostatic latent image with two-component developer, comprising:

a developer holding container (66) comprising a developer storage portion (70) and a developer agitating portion (76) disposed above the developer storage portion, wherein a communicating path (84') is formed between the developer agitating portion and the developer storage portion, and the communicating path is open to the developer agitating portion so that a developer overflow outlet (66*h*') can be formed;

a developer carrier (68) arranged in the developer storage portion of the developer holding container, wherein the developer carrier is partially exposed so that the developer carrier can be opposed to an electrostatic latent image carrier (48), and the developer carrier conveys developer from the developer storage portion to an opposing region in which the developer carrier is opposed to the electrostatic latent image carrier so as to develop an electrostatic latent image on the electrostatic latent image carrier;

a developer lifting means (86, 88, 86') for lifting up the developer conveyed to the opposing region by the developer carrier, to the developer agitating portion of the developer holding container; and a developer agitating means (78*a*, 78*b*) for agitating the developer in the developer agitating portion of the developer holding container, wherein a portion of the developer agitated by this developer agitating means is supplied to the developer storage portion via the developer overflow outlet and the communicating path, characterized in that the developer overflow outlet (66*h*') is formed into a slit-shaped overflow outlet disposed adjacent to the developer lifting means (86, 88, 86'), the slit-shaped overflow outlet is open on a vertical plane, the slit-shaped overflow outlet is extended in a horizontal direction, the developer agitating means is composed of a pair of conveyance screws (78*a*, 78*b*), and the width of the slit-shaped overflow outlet is determined so that a ratio of the width to the outer diameter of the conveyance screw can be in a range from 1/9 to 7/27.

18. The developing unit according to claim 17, the developer agitating portion further includes a toner replenishing means (64) for replenishing a toner component to the developer agitating portion, wherein the toner replenishing means is positioned with respect to the developer agitating portion (76) so that the toner component replenished by the toner replenishing means can be sufficiently agitated by the developer agitating means so as to be triboelectrically charged and then reach the developer overflow outlet (66*h*).

19. The developing unit according to claim 17, wherein the developer lifting means is composed of at least one magnetic roller (86, 88), and magnetic poles of the magnetic roller are arranged so that the magnetic poles can be raised along an exposed face of the developer carrier (68).

20. The developing unit according to claim 17, wherein the developer lifting means comprises a mechanical developer elevating means (86') disposed above the developer carrier (68) and a magnetic roller (88) disposed above the mechanical developer elevating means.

21. The developing unit according to claim 20, wherein the mechanical developer elevating means comprises a paddle wheel (86'), and the paddle wheel is disposed so that the developer can be lifted up from the developer carrier (68) at a position where the magnetic field of the developer carrier disappears.

22. The developing unit according to one of claims 17 to 21, the toner replenishing means (64) includes a toner accommodating portion (64*a*) for accommodating a toner component, a replenishing port (64*a*') arranged in the toner accommodating portion, and a sponge roller (64*c*) for replenishing toner arranged in the replenishing port, wherein the sponge roller for replenishing toner is rotated so that a quantity of toner replenished per unit hour can be made substantially constant irrespective of a quantity of residual toner in the toner accommodating portion.

* * * * *